US008597005B2

(12) United States Patent
Nomura et al.

(10) Patent No.: US 8,597,005 B2
(45) Date of Patent: Dec. 3, 2013

(54) COMPRESSOR INCORPORATED WITH OIL SEPARATOR

(75) Inventors: Tatsuki Nomura, Maebashi (JP); Goushi Iketaka, Iseasaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 1146 days.

(21) Appl. No.: 12/527,393

(22) PCT Filed: Feb. 13, 2008

(86) PCT No.: PCT/JP2008/052339

§ 371 (c)(1), (2), (4) Date: Aug. 14, 2009

(87) PCT Pub. No.: WO2008/099845

PCT Pub. Date: Aug. 21, 2008

(65) Prior Publication Data

US 2010/0095702 A1 Apr. 22, 2010

(30) Foreign Application Priority Data

Feb. 14, 2007 (JP) ..... 2007-033748

(51) Int. Cl.
*F01C 21/04* (2006.01)
*F04C 29/02* (2006.01)

(52) U.S. Cl.
USPC ..... 418/83; 418/55.6; 418/97; 418/100; 418/DIG. 1

(58) Field of Classification Search
USPC ..... 418/83, 97, 100, 55.6, DIG. 1
See application file for complete search history.

(56) References Cited

U.S. PATENT DOCUMENTS

| | | | | |
|---|---|---|---|---|
| 7,731,486 | B2 * | 6/2010 | Yokoyama | 418/55.6 |
| 8,182,565 | B2 * | 5/2012 | Nomura | 418/55.6 |
| 2006/0083649 | A1 * | 4/2006 | Makino et al. | 418/55.6 |
| 2011/0209448 | A1 * | 9/2011 | Watanabe et al. | 55/431 |

FOREIGN PATENT DOCUMENTS

| | | | | |
|---|---|---|---|---|
| JP | 2005083234 | A * | 3/2005 | F04B 39/04 |
| JP | 2005188394 | A * | 7/2005 | F04C 18/02 |
| JP | 2005337142 | A * | 12/2005 | F04B 39/04 |
| JP | 2006017130 | A * | 1/2006 | |
| JP | 2006283605 | A * | 10/2006 | |

* cited by examiner

*Primary Examiner* — Mary A Davis
(74) *Attorney, Agent, or Firm* — Baker Botts L.L.P.

(57) ABSTRACT

A compressor incorporated with an oil separator having a separation chamber, which is placed adjacent to a discharge chamber, has a space formed in the entire inside of the separation chamber, separates oil-containing gas, being introduced, into gas and oil by centrifugal separation, allows the separated oil to drop downward, and upwardly extracts the separated gas, and also having a lower hole for introducing the separated oil into an oil storing chamber. The oil separator is formed as a joining structure of two compressor forming members, and a portion of the oil storing chamber, other than a portion where the lower hole is opened, is communicated with the separation chamber via a gas release passageway at least a part of which is formed between the two compressor forming members. Gas is efficiently discharged from the portion of the oil storing chamber where the lower hole of the oil separator is not opened, a sufficient amount of stored oil is secured in the oil storing chamber, and in addition, workability in production of the device is improved.

33 Claims, 16 Drawing Sheets

COMPRESSOR INCORPORATED WITH OIL SEPARATOR

CROSS-REFERENCE TO RELATED APPLICATIONS

This application is the National Stage of International Patent Application No. PCT/JP2008/052339, filed Feb. 13, 2008, which claims the benefit of Japanese Patent Application No. 2007-033748, filed Feb. 14, 2007, the disclosures of which are incorporated herein by reference in their entirety.

TECHNICAL FIELD OF THE INVENTION

The present invention relates to a compressor incorporated with an oil separator, and specifically, to a compressor incorporated with an oil separator in which simplification of oil separator incorporation mechanism, decrease of number of parts, facilitation of assembly, cost down, etc. are attempted.

BACKGROUND ART OF THE INVENTION

As a compressor assembled in, for example, a refrigeration system of an air conditioning system for vehicles, a compressor incorporated with an oil separator, in which a centrifugal separation system oil separator is incorporated into a compressor, has been known (for example, Patent document 1). In a conventional compressor incorporated with an oil separator, for example, as is shown in FIG. 29 an example of a case of a scroll-type compressor which has a compression mechanism 103 comprising a fixed scroll 101 and a movable scroll 102, a centrifugal separation system oil separator 107 is incorporated into a rear casing 106 forming a discharge chamber 105 into which the gas (for example, refrigerant gas) compressed in compression mechanism 103 is introduced through a discharge hole 104. In such an oil separator 107, a structure is employed wherein a cylindrical cylinder (oil separation chamber 108) is provided in casing 106 as an oil separation section, on the axis thereof a separation pipe 109 is inserted or press fitted, and the upper end side thereof is fixed by or engaged with a snap ring 110. Because the oil separation section is provided only in casing 106 and the oil separation section is formed by machining, a seal bolt 111 is required in order to keep the inside pressure. Further, a discharge port 112 connected to outside of the compressor (external tube) is communicated with a space formed between the upper end of separation pipe 109 and the lower end of seal bolt 111.

The gas compressed in compression mechanism 103 is discharged into discharge chamber 105 through discharge hole 104 of the fixed scroll, and the oil-containing gas in discharge chamber 105 is introduced into oil separation chamber 108 through communication holes 113. The introduced gas rotates around separation pipe 109, and is separated into gas and oil utilizing centrifugal force. The separated gas passes through the inside of separation pipe 109 and is discharged from discharge port 112, and the oil separated by centrifugal force is stored in a lower oil-storing chamber 115 through a lower hole 114. The oil stored in oil-storing chamber 115 is returned to a suction chamber 117 through an orifice 116.

By the way, in the above-described oil separation structure, gas is likely to stay in a space above oil surface 118 of the oil stored in oil storing chamber 115, and there is a fear that the oil level is lowered and the amount of oil in oil storing chamber 115 decreases. In order to solve such a problem, it is necessary to discharge the gas in oil storing chamber 115 to outside. For example, in the compressor shown in FIG. 30

(Patent document 2), a structure is employed wherein gas release passageway 119 is provided between the side of a part 115*a* of the oil storing chamber, which is opened with lower hole 114, and the side of another part 115*b* of the oil storing chamber, which is not opened with lower hole 114, the gas stayed in the part 115*a* side of the oil storing chamber is introduced into the other part 115*b* side of the oil storing chamber, and introduced again into oil separation chamber 108 through lower hole 114, so that the gas can be discharged to outside from the inside of separation pipe 109.

In the compressor disclosed in Patent document 2, however, because the gas stayed in the part 115*a* side of the oil storing chamber is introduced into the other part 115*b* side of the oil storing chamber via gas release passageway 119 and further introduced into separation pipe 109, there is a fear that an efficient gas release from oil storing chamber 115 cannot be achieved sufficiently. Further, because it is necessary to form a groove with a complicated shape, etc. for forming the gas release passageway, the workability in production may be deteriorated.

Patent document 1: JP-A-11-93880

Patent document 2: Japanese Patent 3,847,321

DISCLOSURE OF THE INVENTION

Problems to be Solved by the Invention

Accordingly, an object of the present invention is to provide a compressor incorporated with an oil separator which can secure a sufficient amount of oil stored in an oil storing chamber by efficiently discharging gas from a portion of the oil storing chamber which is not opened with a lower hole of an oil separator, and in addition, which is excellent in workability in production.

Means for Solving the Problems

To achieve the above-described object, a compressor incorporated with an oil separator according to the present invention has a separation chamber, which is placed adjacent to a discharge chamber, has a space formed in the entire inside of the separation chamber, separates oil-containing gas, being introduced, into gas and oil by centrifugal separation, allows the separated oil to drop downward, and upwardly extracts the separated gas, and has a lower hole for introducing the separated oil into an oil storing chamber, wherein the oil separator is formed as a joining structure of two compressor forming members, and a portion of the oil storing chamber, other than a portion where the lower hole is opened, is communicated with the separation chamber via a gas release passageway at least a part of which is formed between the two compressor forming members.

Further, to achieve the above-described object, another compressor incorporated with an oil separator according to the present invention has a separation chamber, which is placed adjacent to a discharge chamber, has a space formed in the entire inside of the separation chamber, separates oil-containing gas, being introduced, into gas and oil by centrifugal separation, allows the separated oil to drop downward, and upwardly extracts the separated gas, and has a lower hole for introducing the separated oil into an oil storing chamber, wherein the oil separator is formed as a joining structure of two compressor forming members, and a portion of the oil storing chamber, other than a portion where the lower hole is opened, is communicated with a passageway for gas having passed through the separation chamber via a gas release passageway at least a part of which is formed between the two compressor forming members.

In the above-described compressors incorporated with oil separators, since a portion of the oil storing chamber other than a portion where the lower hole is opened (hereinafter, referred to as merely "an oil storing chamber portion where a lower hole is not opened") is communicated with the separation chamber or the passageway for gas having passed through the separation chamber via the gas release passageway, the gas stayed in the oil storing chamber portion where the lower hole is not opened is introduced directly into the separation chamber or the passageway for gas having passed through the separation chamber. Therefore, the gas stayed in the oil storing chamber portion where the lower hole is not opened can be discharged securely and efficiently.

Further, to achieve the above-described object, a further compressor incorporated with an oil separator according to the present invention has a separation chamber, which is placed adjacent to a discharge chamber, has a space formed in the entire inside of the separation chamber, separates oil-containing gas, being introduced, into gas and oil by centrifugal separation, allows the separated oil to drop downward, and upwardly extracts the separated gas, and has a lower hole for introducing the separated oil into an oil storing chamber, wherein the oil separator is formed as a joining structure of two compressor forming members, and a portion of the oil storing chamber, other than a portion where the lower hole is opened, is communicated with the separation chamber and a passageway for gas having passed through the separation chamber via a gas release passageway at least a part of which is formed between the two compressor forming members.

In the above-described compressor incorporated with an oil separator, since the oil storing chamber portion where the lower hole is not opened is communicated with the separation chamber and the passageway for gas having passed through the separation chamber via the gas release passageway, the gas stayed in the oil storing chamber portion where the lower hole is not opened is introduced directly into the separation chamber and the passageway for gas having passed through the separation chamber. Therefore, the gas stayed in the oil storing chamber portion where the lower hole is not opened can be discharged securely and efficiently.

As to the opening of the gas release passageway to the separation chamber or to the passageway for gas having passed through the separation chamber, or the openings of the gas release passageway to the separation chamber and to the passageway for gas having passed through the separation chamber, a plurality of openings may be provided. In such a structure, more efficiently the gas can be discharged from the oil storing chamber portion where the lower hole is not opened.

Further, a structure may be employed wherein a stepped portion or a dam portion is provided in the passageway for gas having passed through the separation chamber. Thus, by devising the shape of the gas passageway between the separation chamber and the discharge port, flowing out of oil from the discharge port can be decreased.

Further, to achieve the above-described object, a still further compressor incorporated with an oil separator according to the present invention has a separation chamber, which is placed adjacent to a discharge chamber, is provided therein with an oil separation pipe, separates oil-containing gas, being introduced, into gas and oil by centrifugal separation, allows the separated oil to drop downward, and upwardly extracts the separated gas through the oil separation pipe, and has a lower hole for introducing the separated oil into an oil storing chamber, wherein the oil separator is formed as a joining structure of two compressor forming members, and a portion of the oil storing chamber, other than a portion where the lower hole is opened, is communicated with a lower portion of the separation chamber via a gas release passageway at least a part of which is formed between the two compressor forming members.

Further, to achieve the above-described object, a still further compressor incorporated with an oil separator according to the present invention has a separation chamber, which is placed adjacent to a discharge chamber, is provided therein with an oil separation pipe, separates oil-containing gas, being introduced, into gas and oil by centrifugal separation, allows the separated oil to drop downward, and upwardly extracts the separated gas through the oil separation pipe, and has a lower hole for introducing the separated oil into an oil storing chamber, wherein the oil separator is formed as a joining structure of two compressor forming members, and a portion of the oil storing chamber, other than a portion where the lower hole is opened, is communicated with a passageway for gas having passed through the separation chamber via a gas release passageway at least a part of which is formed between the two compressor forming members.

In such compressors incorporated with oil separators, since the oil storing chamber portion where the lower hole is not opened is communicated with the lower portion of the separation chamber or the passageway for gas having passed through the separation chamber via the gas release passageway, the gas stayed in the oil storing chamber portion where the lower hole is not opened is introduced into the lower portion of the separation chamber or the passageway for gas having passed through the separation chamber via the gas release passageway. Therefore, the gas stayed in the oil storing chamber portion where the lower hole is not opened can be discharged securely and efficiently.

It is possible to form a plurality of lower holes in the above-described separation chamber. In the embodiment forming a plurality of lower holes, it is also possible to give a function as a gas passageway mainly from the oil storing chamber to the separation chamber to a part of lower holes.

It is possible to form a part of the above-described gas release passageway by utilizing a gap at a seal member providing portion between the two members. In such a structure, because it becomes unnecessary to form a groove with a complicated shape, etc. for forming the gas release passageway, the workability in production may be improved.

In this compressor incorporated with an oil separator according to the present invention, although the oil separator is formed as a centrifugal system oil separator, the separation chamber can be formed either in a cylindrical shape whose generating line extends straightly similarly in the conventional shape, or in a cylindrical shape whose generating line extends curvedly (a separation chamber formed as a whole in a doughnut shape (a shape forming a part of a doughnut shape)). In particular, by forming the separation chamber in a cylindrical shape with a curvature (a doughnut shape), the freedom in layout greatly increases, and the whole of the compressor may be formed compact.

Further, with respect to the cross-sectional shape in the above-described cylindrical shape, although a substantially complete circle is preferable, for forming the joining structure of the two members, a structure may be employed wherein a small difference in level on the inner surface of the cylindrical shape occurs, or a structure may be employed wherein a difference in curvature between arcs in the cross-sections of the cylindrical shapes of the two members forming the inner surface of the cylindrical shape occurs. Further, when the inner surface of the cylindrical shape is formed, a difference in circumferential length of inner surface may occur between the two members. Furthermore, a difference may occur between the depths of arc-like grooves in the cross section of the cylindrical shape, formed by the two members forming the inner surface of the cylindrical shape.

Further, in order to ensure an excellent oil separation ability, it may be realized by changing the blow direction of oil-containing gas introduced from the communication hole into the oil separation chamber to a direction different from that in the conventional structure. For example, by employing a structure wherein the opening direction to the separation chamber of the communication hole is directed to the oil storing chamber side, it becomes possible to efficiently separate oil toward the oil storing chamber side while effectively operating the centrifugal force for separation to the oil.

As to this communication hole to the separation chamber, it is possible to provide a plurality of holes. In case of providing a plurality of holes, a structure may be employed wherein the opening directions to the separation chamber of the plurality of communication holes are set at a same direction. In such a structure, even in a case where the amount of gas blown to the oil separation chamber is relatively much, the gas blows through respective communication holes may be optimized, respectively, and it becomes possible to introduce efficiently separated oil into the oil storing chamber. Further, a structure is also preferable wherein opening directions to the separation chamber of the plurality of communication holes are set at directions different from each other. In such a structure, the angle of the direction of the gas blown into the oil separation chamber is changed for each communication hole, gas blow in accordance with the shape of the oil separation chamber, etc. becomes possible, an efficient separation becomes possible, and it becomes possible to efficiently introduce the separated oil into the oil storing chamber.

Although such a structure incorporated with an oil separator according to the present invention can be applied to substantially any type compressor, especially it is suitable to a scroll-type compressor. In case of scroll-type compressor, for example, a structure can be employed wherein one of the two members is a fixed scroll forming member, and the other is a compressor casing.

Effect According to the Invention

As described above, in the compressor incorporated with an oil separator according to the present invention, since the oil storing chamber portion where the lower hole is not opened is communicated with the separation chamber or the passageway for gas having passed through the separation chamber via the gas release passageway, gas can be efficiently discharged from the oil storing chamber portion where the lower hole is not opened, and the amount of oil in the oil storing chamber can be secured sufficiently. Further, because a part of the gas release passageway can be formed by utilizing a gap at the seal member providing portion between the two compressor forming members, the workability in production can be improved as compared with that in the conventional compressor having a gas release passageway (FIG. 30).

EXPLANATION OF SYMBOLS

Figure 1:
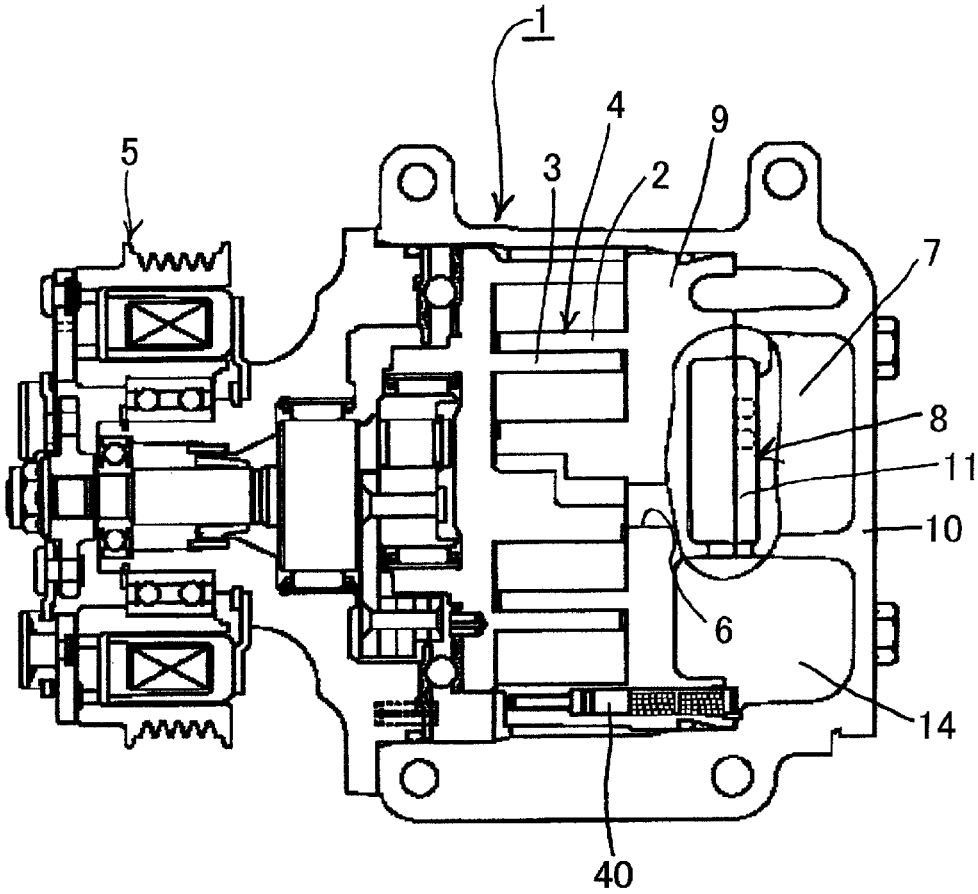
FIG. 1 is a vertical sectional view of a compressor incorporated with an oil separator according to a first embodiment of the present invention.

1: compressor incorporated with an oil separator
2: fixed scroll
3: movable scroll
4: compression mechanism
5: clutch mechanism
6: discharge hole
7: discharge chamber
8, 25: oil separator
9: fixed scroll forming member
10: compressor casing
11, 26: separation chamber
12, 13, 32, 33: communication hole
14, 35: oil storing chamber
14*a*, 35*a*: oil storing chamber portion where a lower hole is opened
14*b*, 14*c*, 35*b*, 35*c*: oil storing chamber portion where a lower hole is not opened
15, 34: lower hole
16, 16*a*, 16*b*, 16*c*, 16*d*, 16*e*, 16*f*, 22, 22*a*, 22*b*, 22*c*, 22*d*, 22*e*, 22*f*, 22*g*, 22*h*, 22*i*, 23, 23*a*, 23*b*, 23*c*, 23*d*, 23*e*, 36, 36*a*, 36*b*, 36*c*, 37, 37*a*, 37*b*, 37*c*, 37*d*, 41, 41*a*, 41*b*, 41*c*, 41*d*, 42, 42*a*, 42*b*, 42*c*, 42*d*, 42*e*, 43, 43*a*, 43*b*, 43*c*, 43*d*, 43*e*, 43*f*: gas release passageway
17: seal member
18, 30: passageway for gas having passed through separation chamber
19, 31: discharge port
20: stepped portion (or dam portion)
21: passageway
24: passageway
27: separation pipe
28: snap ring
29: seal bolt
40: orifice

THE BEST MODE FOR CARRYING OUT THE INVENTION

Hereinafter, desirable embodiments of a compressor incorporated with an oil separator according to the present invention will be explained referring to figures.

Figure 2:
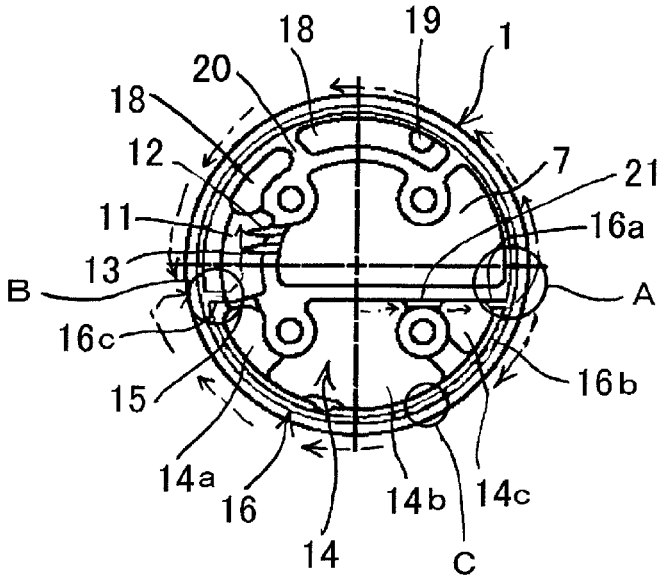
FIG. 2 is a cross-sectional view of a portion including a discharge chamber in the compressor depicted in FIG. 1.
Figure 3:
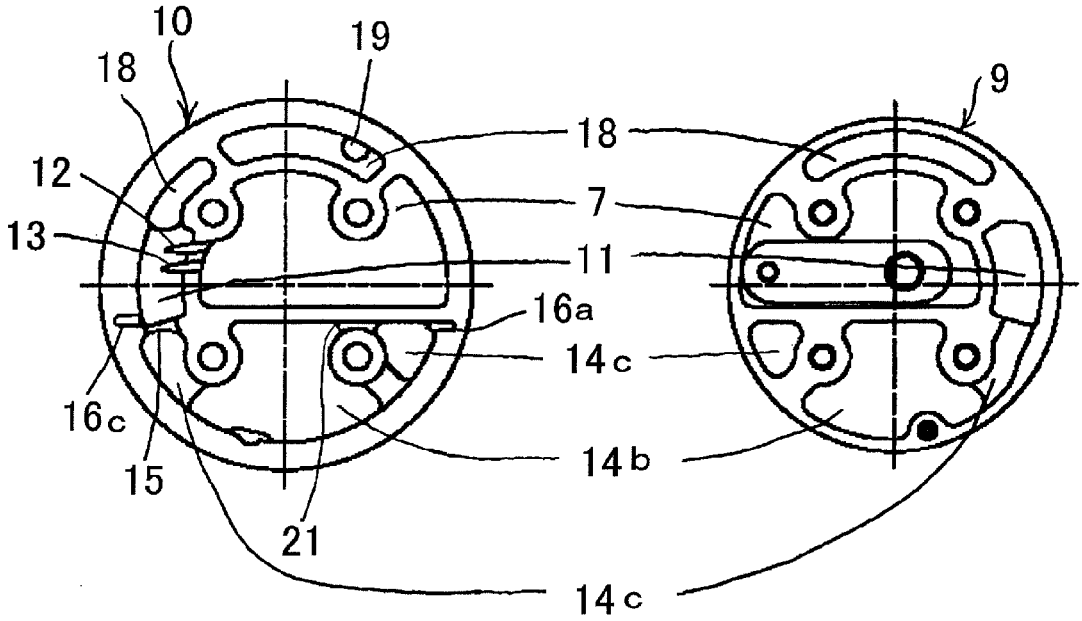
FIG. 3 is an exploded diagram showing a combination of a fixed scroll forming member and a casing which form an oil separator of the compressor depicted in FIG. 1.

FIGS. 1-3 depict a compressor incorporated with an oil separator according to a first embodiment of the present invention. In the figures, symbol 1 indicates a compressor incorporated with an oil separator formed as a scroll-type compressor. Compressor 1 has a compression mechanism 4 comprising a fixed scroll 2 and a movable scroll 3. Further, compressor 1 has a clutch mechanism 5, and by on/off operation of clutch mechanism 5, power from an external drive source (for example, an engine, a motor, etc. as a vehicle prime mover) is transmitted to and interrupted from movable scroll 3. When the power is transmitted to movable scroll 3, the movable scroll 3 operates at an orbital movement around fixed scroll 2, the gas (for example, refrigerant) is compressed in compression mechanism 4, and the compressed gas is discharged into a discharge chamber 7 through a discharge hole 6.

An oil separator 8 is incorporated at an appropriate position around discharge chamber 7. As shown in FIGS. 2 and 3, this oil separator 8 is formed by a joining structure of two members of a fixed scroll forming member 9 and a compressor casing 10. Oil separator 8 has a separation chamber 11 for separating oil from gas by centrifugal force. In this embodiment, separation chamber 11 is formed in a cylindrical shape whose generating line extends curvedly (a cylindrical shape forming a part of a doughnut shape). Alternatively, it is possible to form separation chamber 11 as a cylindrical shape whose generating line extends straightly.

Separation chamber 11 and discharge chamber 7 are disposed adjacent to each other, and between separation chamber 11 and discharge chamber 7, a plurality of communication holes 12, 13 are provided for introducing oil-containing gas from discharge chamber 7 into separation chamber 11. In this embodiment, communication holes 12, 13 are arranged in a direction extending from an upper gas release side to a lower oil drop side. When oil-containing gas is introduced from communication holes 12, 13 into separation chamber 11, a flow is formed along the inner surface of separation chamber 11, and oil in gas is separated by centrifugal force.

Figure 31:
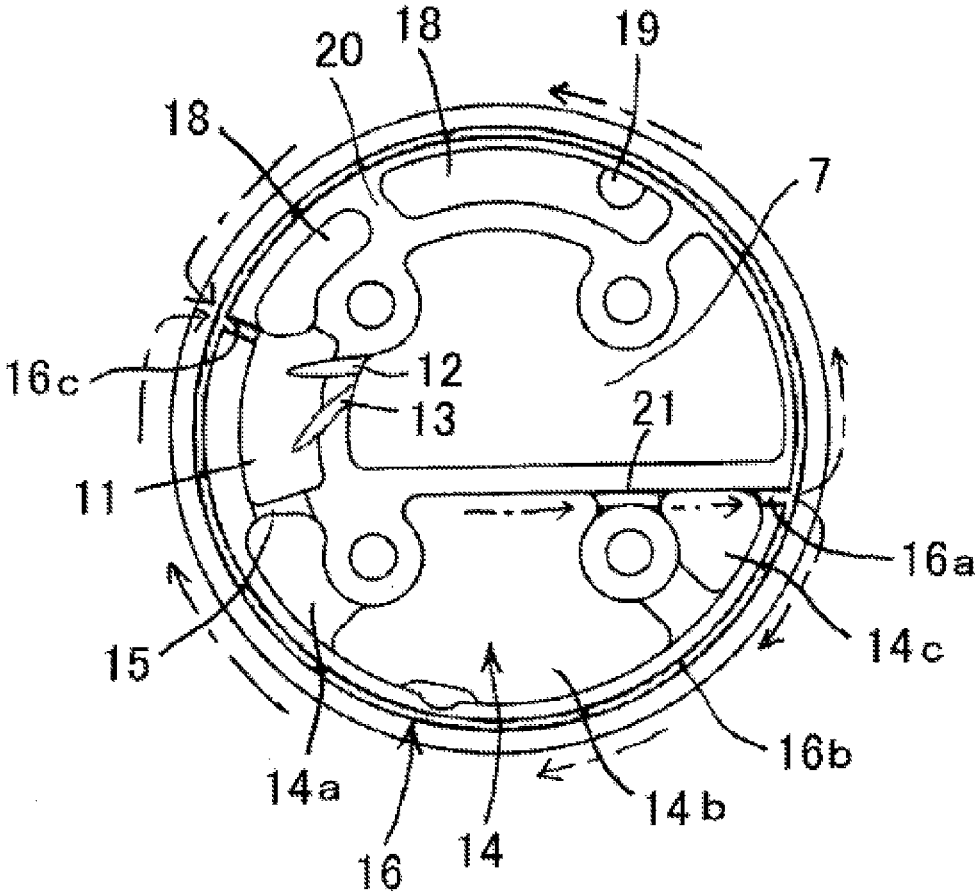
FIG. 31 is a cross-sectional view of a portion including a discharge chamber of a compressor incorporated with an oil separator according to an embodiment of the present invention in which the opening directions of the respective communication holes 12, 13 are different from each other.

Although communication holes 12, 13 are both opened in the direction toward oil storing chamber 14, in an embodiment having a plurality of communication holes, it is possible to change the opening directions of the respective communication holes 12, 13 different from each other, and the opening directions of the respective communication holes can be set at optimum states. Namely, in an embodiment having a plurality of communication holes, such as that depicted in FIG. 31, it is possible to appropriately change the opening directions of the respective communication holes in consideration of the shape of separation chamber 11, etc.

Figure 4:
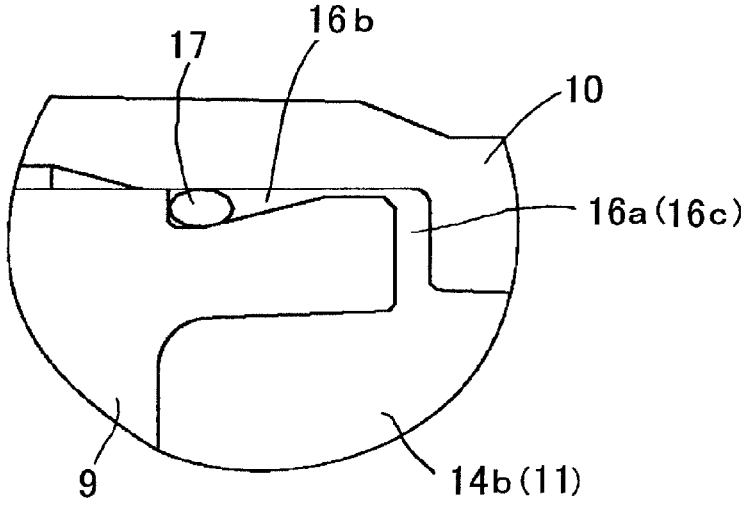
FIG. 4 is an enlarged sectional view of the portion A or B in FIG. 2.
Figure 5:
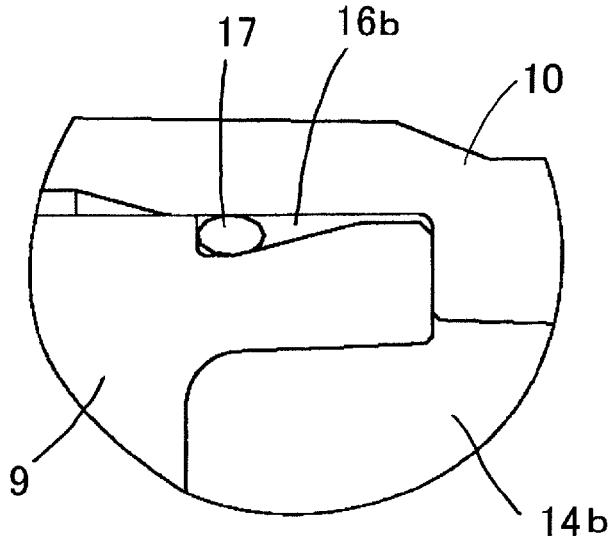
FIG. 5 is an enlarged sectional view of the portion C in FIG. 2.

The oil separated in separation chamber 11 is introduced into oil-storing chamber 14 through a lower hole 15 provided at a lower end of separation chamber 11. The oil stored in oil-storing chamber 14 is returned to the compression mechanism 4 side through an orifice 40. Oil-storing chamber 14 comprises an oil-storing chamber portion 14*a* where the lower hole is opened and oil-storing chamber portions 14*b*, 14*c* where the lower hole is not opened. Further, oil-storing chamber portions 14*b*, 14*c*, where lower hole 15 is not opened, are communicated with each other via a passageway 21. Oil-storing chamber portion 14*c*, where lower hole 15 is not opened, is communicated with separation chamber 11 via gas release passageway 16. Gas release passageway 16 comprises a gas release passageway 16*a* leading out gas from oil-storing chamber portion 14*c* where the lower hole is not opened, a gas release passageway 16*b* introduced with gas from gas release passageway 16*a* and formed to extend in the circumferential direction of compressor 1 as shown in FIG. 2, and a gas release passageway 16*c* communicating between gas release passageway 16*b* and separation chamber 11. In this embodiment, as shown in FIGS. 4 and 5, gas release passageway 16*b* is formed by utilizing a gap at a seal member providing portion where a seal member 17 (O-ring) is provided between fixed scroll forming member 9 and compressor casing 10. Further, gas release passageways 16*a*, 16*c* and passageway 21 can be easily formed from a groove or grooves, etc. formed on any one or both of fixed scroll forming member 9 and compressor casing 10.

On the other hand, the gas separated in separation chamber 11 is discharged from a discharge port 19 to outside of the compressor through a passageway 18 for gas having passed the separation chamber which is communicated with the upper end of separation chamber 11. In this embodiment, as depicted in FIG. 2, a stepped portion 20 (or a dam portion) is provided in gas passageway 18, and by the presence of stepped portion 20, the flow in gas passageway 18 is curved, thereby suppressing the oil from flowing out from discharge port 19 toward outside.

In compressor incorporated with an oil separator 1 formed as a scroll-type compressor which is constructed as described above, since oil-storing chamber portion 14*b* where the lower hole is not opened is communicated with oil-storing chamber portion 14*c* where the lower hole is not opened, via passageway 21, and further the oil-storing chamber portion 14*c* is communicated with separation chamber 11 via gas release passageway 16, gas stayed in the oil-storing chamber portions 14*b* and 14*c* on each of which the lower hole is not opened is introduced into separation chamber 11 by forming a flow path such as gas release passageway 16*a*-gas release passageway 16*b*-gas release passageway 16*c*. Therefore, the gas stayed in the oil-storing chamber portions 14*b* and 14*c* on each of which the lower hole is not opened can be discharged efficiently and securely. The flow path for gas release from oil-storing chamber portion 14*c* where the lower hole is not opened up to separation chamber 11 is shown in FIG. 2 by arrows (chain lines). Where, the gas stayed in oil-storing chamber portion 14*a* where the lower hole is opened is introduced into separation chamber 11 via lower hole 15, and then introduced into gas passageway 18 communicated with the upper end of separation chamber 11.

Further, because gas release passageway 16*b* forming a part of gas release passageway 16 is formed by utilizing a gap at a seal member providing portion where seal member 17 (O-ring) is provided between fixed scroll forming member 9 and compressor casing 10, it becomes unnecessary to separately form a groove with a complicated shape, etc. in order to form the gas release passageway 16*b*, and therefore, the workability in production can be improved.

Figure 6:
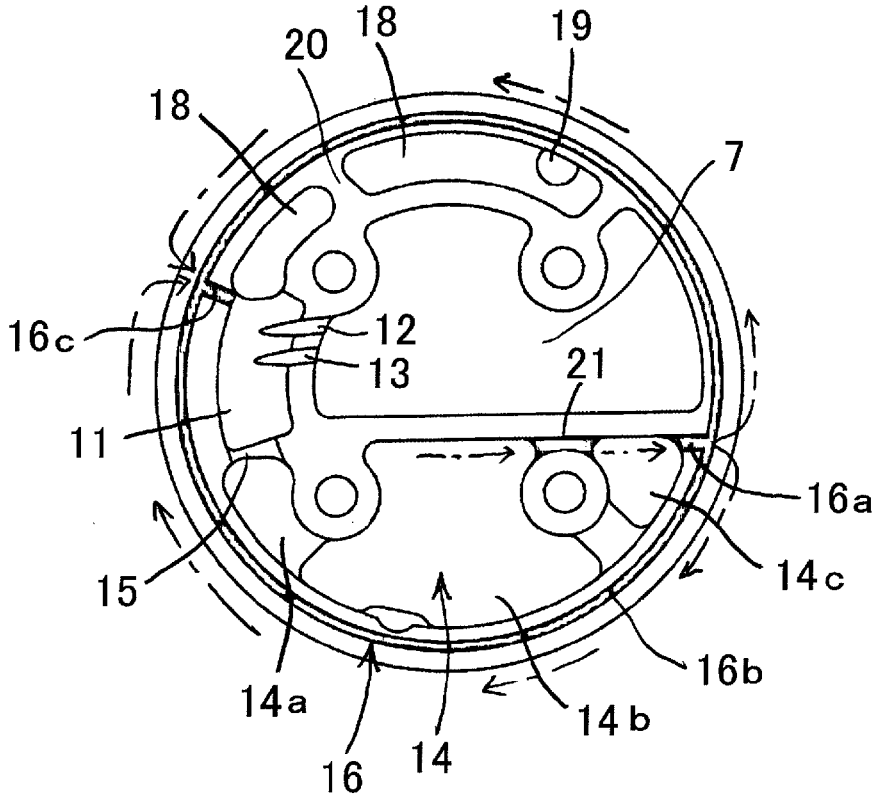
FIG. 6 is a cross-sectional view of a portion including a discharge chamber of a compressor incorporated with an oil separator according to a second embodiment of the present invention.
Figure 7:
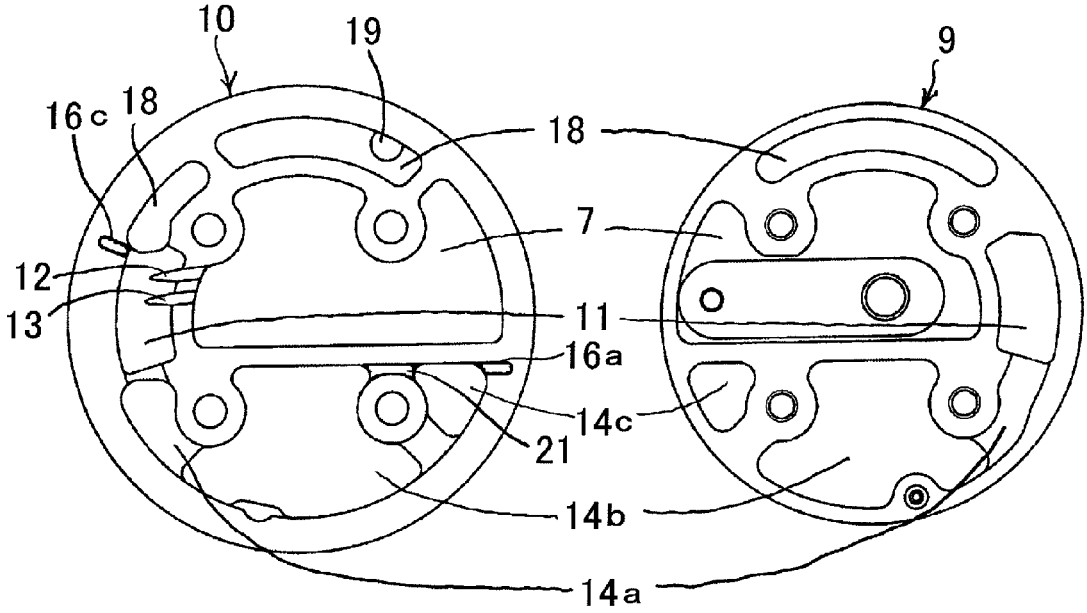
FIG. 7 is an exploded diagram showing a combination of a fixed scroll forming member and a casing which form an oil separator of the compressor depicted in FIG. 6.

FIGS. 6 and 7 depict a compressor incorporated with an oil separator according to a second embodiment of the present invention. Where, because the basic constitution of this embodiment is about same as that of the above-described first embodiment, the explanation for the same members as those in the first embodiment will be omitted by using the same symbols as those used in the first embodiment. Although gas release passageway 16*c* is opened at the lower end side of separation chamber 11 in the first embodiment, in this embodiment, a gas release passageway 16*d* communicating between gas release passageway 16*b* and separation chamber 11 is opened at the upper end side of separation chamber 11. Also in such a structure, similarly to in the first embodiment, the gas stayed in the oil-storing chamber portions 14*b* and 14*c* on each of which the lower hole is not opened can be discharged efficiently and securely.

Figure 8:
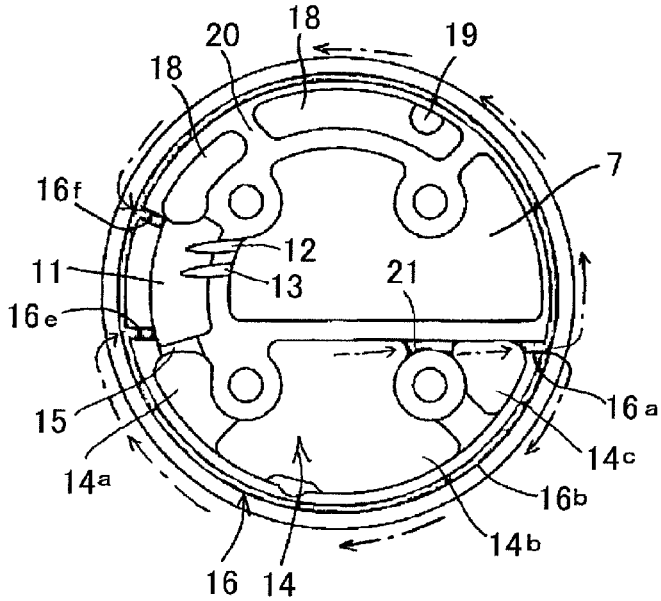
FIG. 8 is a cross-sectional view of a portion including a discharge chamber of a compressor incorporated with an oil separator according to a third embodiment of the present invention.

FIG. 8 depicts a compressor incorporated with an oil separator according to a third embodiment of the present invention. Where, the explanation for the same members as those in the above-described first embodiment will be omitted by using the same symbols as those used in the first embodiment. In this embodiment, oil-storing chamber portion 14*c* where the lower hole is not opened is communicated with separation chamber 11 via gas release passageway 16. The gas release passageway 16 comprises gas release passageway 16*a* leading out gas from oil-storing chamber portion 14*c* where the lower hole is not opened, gas release passageway 16*b* introduced with gas from gas release passageway 16*a* and formed to extend in the circumferential direction of compressor 1 as shown in FIG. 8, and gas release passageways 16*e*, 16*f* communicating between gas release passageway 16*b* and separation chamber 11. In this embodiment, gas release passageway 16*e* is opened at the lower end side of separation chamber 11, gas release passageway 16*f* is opened at the upper end side of separation chamber 11, and a plurality of openings of gas release passageway 16 to separation chamber 11 are provided. Further, in this embodiment, as shown in FIGS. 4 and 5, gas release passageway 16*b* is formed by utilizing a gap at a seal member providing portion where seal member 17 (O-ring) is provided between fixed scroll forming member 9 and compressor casing 10. Further, gas release passageways 16*a*, 16*e*, 16*f* and passageway 21 can be easily formed from a groove or grooves, etc. formed on any one or both of fixed scroll forming member 9 and compressor casing 10.

In compressor incorporated with an oil separator 1 formed as a scroll-type compressor which is constructed as described above, gas stayed in the oil-storing chamber portions 14*b* and 14*c* on each of which the lower hole is not opened is introduced into separation chamber 11 by forming a flow path such as gas release passageway 16*a*-gas release passageway 16*b*-gas release passageway 16*e* (or gas release passageway 16*f*). Therefore, the gas stayed in the oil-storing chamber portions 14*b* and 14*c* on each of which the lower hole is not opened can be discharged efficiently and securely. The flow path for gas release from oil-storing chamber portion 14*c* where the lower hole is not opened up to separation chamber 11 is shown in FIG. 8 by arrows (chain lines). Further, because the flow path from oil-storing chamber portion 14*c* up to separation chamber 11 is formed by two gas release passageways 16*e* and 16*f*, the pressure loss in the flow path from oil-storing chamber portion 14*c* up to separation chamber 11 can be greatly decreased. Where, the gas stayed in oil-storing chamber portion 14*a* where the lower hole is opened is introduced into separation chamber 11 via lower hole 15, and then introduced into gas passageway 18 communicated with the upper end of separation chamber 11.

Further, because gas release passageway 16*b* forming a part of gas release passageway 16 is formed by utilizing a gap at a seal member providing portion where seal member 17 (O-ring) is provided between fixed scroll forming member 9 and compressor casing 10, it becomes unnecessary to separately form a groove with a complicated shape, etc. in order to form the gas release passageway 16*b*, and therefore, the workability in production can be improved.

Figure 9:
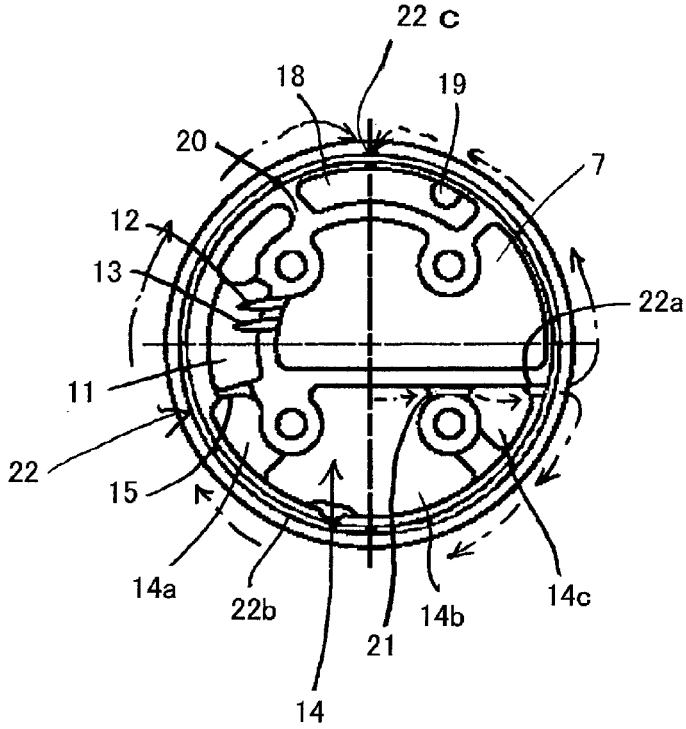
FIG. 9 is a cross-sectional view of a portion including a discharge chamber of a compressor incorporated with an oil separator according to a fourth embodiment of the present invention.
Figure 10:
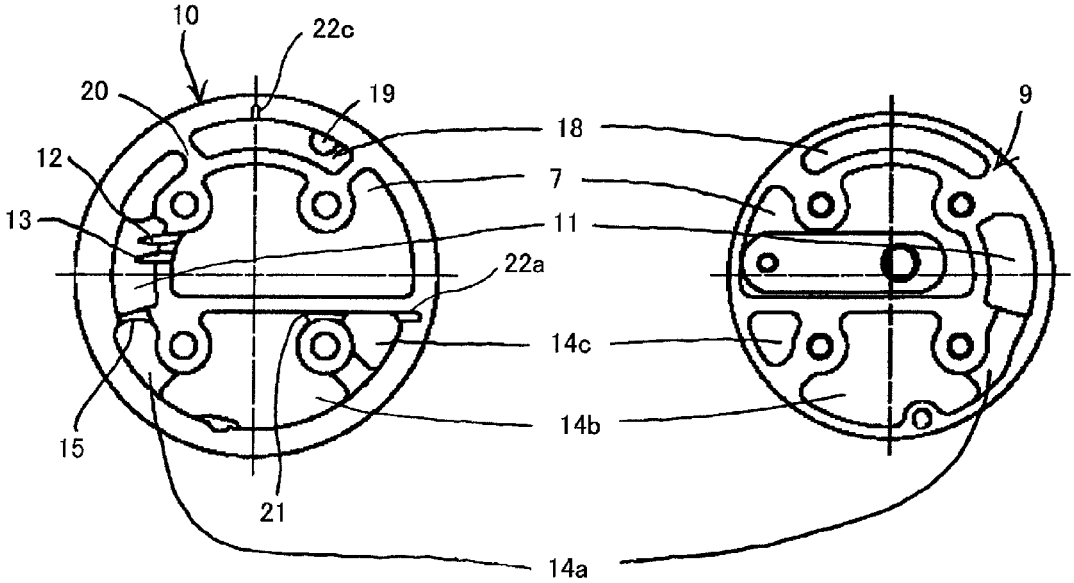
FIG. 10 is an exploded diagram showing a combination of a fixed scroll forming member and a casing which form an oil separator of the compressor depicted in FIG. 9.

FIGS. 9 and 10 depict a compressor incorporated with an oil separator according to a fourth embodiment of the present invention. Where, the explanation for the same members as those in the above-described first embodiment will be omitted by using the same symbols as those used in the first embodiment. In this embodiment, oil-storing chamber portion 14*b* and oil-storing chamber portion 14*c* are communicated with each other via passageway 21, and oil-storing chamber portion 14*c* is communicated with passageway 18 for gas having passed through the separation chamber via gas release passageway 22. The gas release passageway 22 comprises gas release passageway 22*a* communicating with oil-storing chamber portion 14*c* where the lower hole is not opened, gas release passageway 22*b* introduced with gas from gas release passageway 22*a* and formed to extend in the circumferential direction of the compressor as shown in FIG. 9, and gas release passageway 22*c* formed in casing 10 and communicating between passageway 18 for gas having passed through the separation chamber and gas release passageway 22*b*. Gas release passageway 22*c* extends in the axial direction of the compressor.

Also in the compressor incorporated with an oil separator formed as a scroll-type compressor thus constructed, gas stayed in oil-storing chamber portions 14*b* and 14*c* on each of which the lower hole is not opened is introduced into passageway 18 for gas having passed through the separation chamber by forming a flow path such as gas release passageway 22*a*-gas release passageway 22*b*-gas release passageway 22*c*. Therefore, the gas stayed in the oil-storing chamber portions 14*b* and 14*c* on each of which the lower hole is not opened can be discharged efficiently and securely. The flow path for gas release from oil-storing chamber portion 14*c* where the lower hole is not opened up to passageway 18 for gas having passed through the separation chamber is shown in FIG. 9 by arrows (chain lines).

Further, because gas release passageway 22*b* forming a part of gas release passageway 22 is formed by utilizing a gap at a seal member providing portion where seal member 17 (O-ring) is provided between fixed scroll forming member 9 and compressor casing 10, it becomes unnecessary to separately form a groove with a complicated shape, etc. in order to form the gas release passageway 22*b*, and therefore, the workability in production can be improved.

Figure 11:
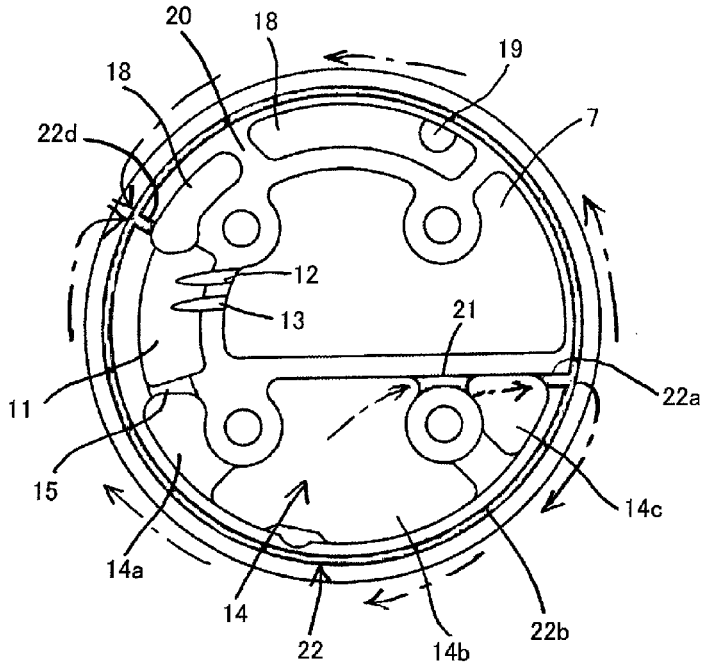
FIG. 11 is a cross-sectional view of a portion including a discharge chamber of a compressor incorporated with an oil separator according to a fifth embodiment of the present invention.
Figure 12:
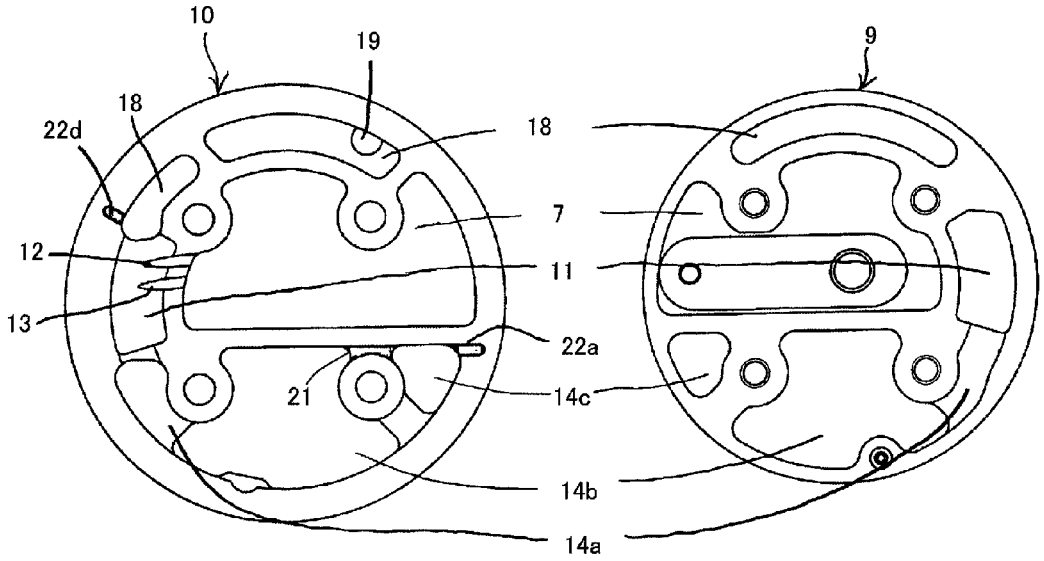
FIG. 12 is an exploded diagram showing a combination of a fixed scroll forming member and a casing which form an oil separator of the compressor depicted in FIG. 11.

FIGS. 11 and 12 depict a compressor incorporated with an oil separator according to a fifth embodiment of the present invention. Where, the explanation for the same members as those in the above-described first embodiment will be omitted by using the same symbols as those used in the first embodiment. In this embodiment, oil-storing chamber portion 14*c* is communicated with passageway 18 for gas having passed through the separation chamber via gas release passageway 22. The gas release passageway 22 comprises gas release passageway 22*a* communicating with oil-storing chamber portion 14*c* where the lower hole is not opened, gas release passageway 22*b* introduced with gas from gas release passageway 22*a* and formed to extend in the circumferential direction of the compressor as shown in FIG. 11, and gas release passageway 22*d* communicating with passageway 18 for gas having passed through the separation chamber.

Also in the compressor incorporated with an oil separator formed as a scroll-type compressor thus constructed, gas stayed in oil-storing chamber portions 14*b* and 14*c* on each of which the lower hole is not opened is introduced into passageway 18 for gas having passed through the separation chamber by forming a flow path such as gas release passageway 22*a*-gas release passageway 22*b*-gas release passageway 22*d*. Therefore, the gas stayed in the oil-storing chamber portions 14*b* and 14*c* on each of which the lower hole is not opened can be discharged efficiently and securely. The flow path for gas release from oil-storing chamber portion 14*c* where the lower hole is not opened up to passageway 18 for gas having passed through the separation chamber is shown in FIG. 11 by arrows (chain lines).

Figure 13:
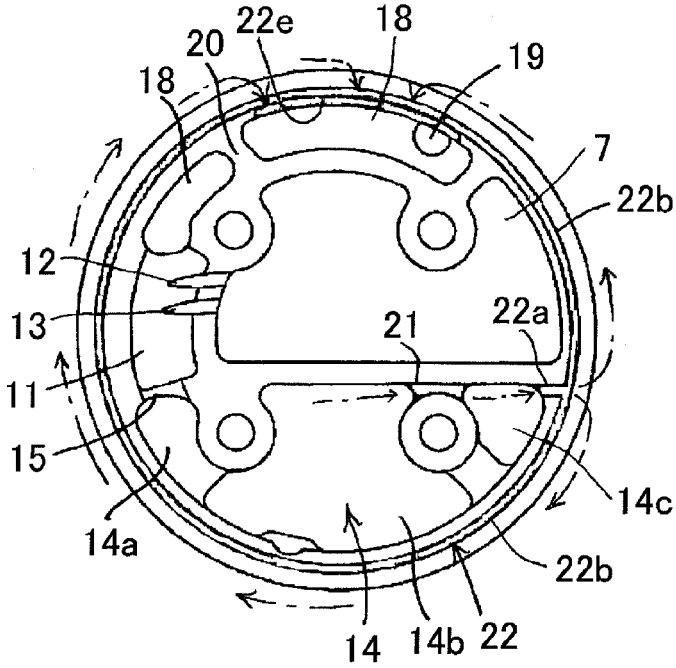
FIG. 13 is a cross-sectional view of a portion including a discharge chamber of a compressor incorporated with an oil separator according to a sixth embodiment of the present invention.

FIG. 13 depicts a compressor incorporated with an oil separator according to a sixth embodiment of the present invention. Where, the explanation for the same members as those in the above-described first embodiment will be omitted by using the same symbols as those used in the first embodiment. In this embodiment, oil-storing chamber portion 14*b* where the lower hole is not opened is communicated with oil-storing chamber portion 14*c* where the lower hole is not opened, via passageway 21, and further, the oil-storing chamber portion 14*c* is communicated with passageway 18 for gas having passed through the separation chamber via gas release passageway 22. The gas release passageway 22 comprises gas release passageway 22*a* communicating with oil-storing chamber portion 14*c* where the lower hole is not opened, gas release passageway 22*b* introduced with gas from gas release passageway 22*a* and formed to extend in the circumferential direction of the compressor as shown in FIG. 13, and gas release passageway 22*e* communicating with passageway 18 for gas having passed through the separation chamber. Gas release passageway 22*e* extends in the circumferential direction of the compressor.

Also in the compressor incorporated with an oil separator formed as a scroll-type compressor thus constructed, gas stayed in oil-storing chamber portions 14*b* and 14*c* on each of which the lower hole is not opened is introduced into passageway 18 for gas having passed through the separation chamber by forming a flow path such as gas release passageway 22*a*-gas release passageway 22*b*-gas release passageway 22*e*. Therefore, the gas stayed in the oil-storing chamber portions 14*b* and 14*c* on each of which the lower hole is not opened can be discharged efficiently and securely. The flow path for gas release from oil-storing chamber portion 14*c* where the lower hole is not opened up to passageway 18 for gas having passed through the separation chamber is shown in FIG. 13 by arrows (chain lines). Further, in this embodiment, because gas release passageway 22*e* extends in the circumferential direction of the compressor and the opening thereof to passageway 18 for gas having passed through the separation chamber is set large, the pressure loss in the flow path of gas release passageway 22*b*-gas release passageway 22*e*-passageway 18 for gas having passed through the separation chamber can be decreased.

Figure 14:
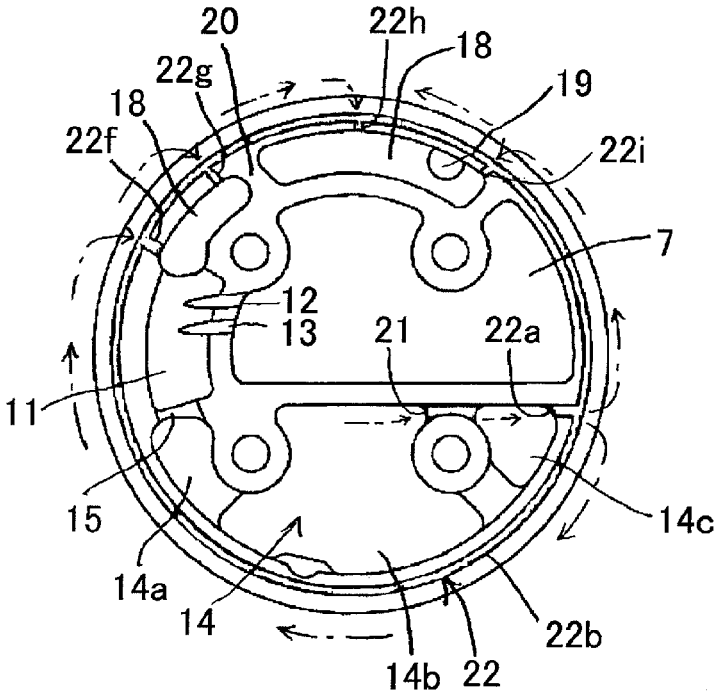
FIG. 14 is a cross-sectional view of a portion including a discharge chamber of a compressor incorporated with an oil separator according to a seventh embodiment of the present invention.

FIG. 14 depicts a compressor incorporated with an oil separator according to a seventh embodiment of the present invention. Where, the explanation for the same members as those in the above-described first embodiment will be omitted by using the same symbols as those used in the first embodiment. In this embodiment, oil-storing chamber portion 14*b* where the lower hole is not opened is communicated with oil-storing chamber portion 14*c* where the lower hole is not opened, via passageway 21, and further, the oil-storing chamber portion 14*c* is communicated with passageway 18 for gas having passed through the separation chamber via gas release passageway 22. The gas release passageway 22 comprises gas release passageway 22*a* communicating with oil-storing chamber portion 14*c* where the lower hole is not opened, gas release passageway 22*b* introduced with gas from gas release passageway 22*a* and formed to extend in the circumferential direction of the compressor as shown in FIG. 14, and gas release passageways 22*f*, 22*g*, 22*h*, 22*i* communicating with passageway 18 for gas having passed through the separation chamber.

Also in the compressor incorporated with an oil separator formed as a scroll-type compressor thus constructed, gas stayed in oil-storing chamber portions 14*b* and 14*c* on each of which the lower hole is not opened is introduced into passageway 18 for gas having passed through the separation chamber by forming a flow path such as gas release passageway 22*a*-gas release passageway 22*b*-gas release passageways 22*f*, 22*g*, 22*h*, 22*i*. Therefore, the gas stayed in the oil-storing chamber portions 14*b* and 14*c* on each of which the lower hole is not opened can be discharged efficiently and securely. The flow path for gas release from oil-storing chamber portion 14*c* where the lower hole is not opened up to passageway 18 for gas having passed through the separation chamber is shown in FIG. 14 by arrows (chain lines). Further, in this embodiment, because the flow path from gas release passageway 22*b* up to passageway 18 for gas having passed through the separation chamber is formed from a plurality of gas release passageways 22*f*, 22*g*, 22*h*, 22*i*, the pressure loss in the flow path of from gas release passageway 22*b* up to passageway 18 for gas having passed through the separation chamber can be decreased.

Figure 15:
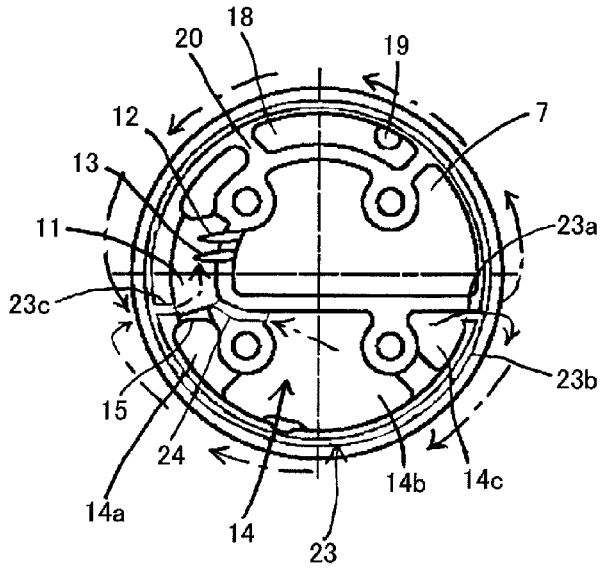
FIG. 15 is a cross-sectional view of a portion including a discharge chamber of a compressor incorporated with an oil separator according to an eighth embodiment of the present invention.
Figure 16:
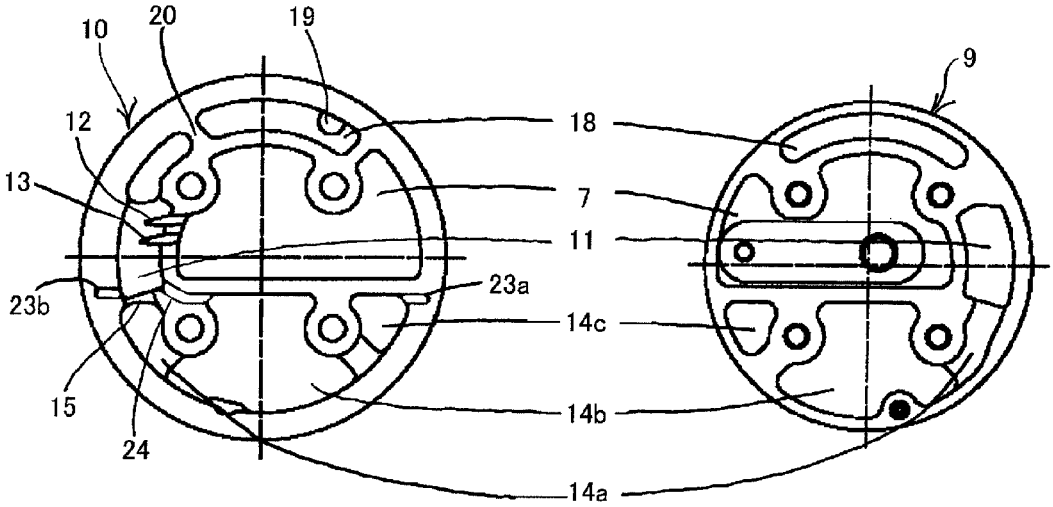
FIG. 16 is an exploded diagram showing a combination of a fixed scroll forming member and a casing which form an oil separator of the compressor depicted in FIG. 15.

FIGS. 15 and 16 depict a compressor incorporated with an oil separator according to an eighth embodiment of the present invention. Where, the explanation for the same members as those in the above-described first embodiment will be omitted by using the same symbols as those used in the first embodiment. In this embodiment, oil-storing chamber portion 14*b* where the lower hole is not opened is communicated with separation chamber 11 via passageway 24, and oil-storing chamber portion 14*c* is communicated with separation chamber 11 via gas release passageway 23. The gas release passageway 23 comprises gas release passageway 23*a* communicating with oil-storing chamber portion 14*c* where the lower hole is not opened, gas release passageway 23*b* introduced with gas from gas release passageway 23*a* and formed to extend in the circumferential direction of the compressor as shown in FIG. 15, and gas release passageway 23*c* communicating between gas release passageway 23*b* and separation chamber 11.

Further, lower hole 15, and passageway 24 which is communicated with oil-storing chamber portion 14*b* where the lower hole is not opened, are provided at the lower end of separation chamber 11. Therefore, in this embodiment, substantially a plurality of so-called lower holes are provided in separation chamber 11.

In this embodiment, gas stayed in oil-storing chamber portion 14*c* where the lower hole is not opened is introduced into separation chamber 11 by forming a flow path such as gas release passageway 23*a*-gas release passageway 23*b*-gas release passageway 23*c*. Therefore, the gas stayed in the oil-storing chamber portion 14*c* where the lower hole is not opened can be discharged efficiently and securely. The flow path for gas release from oil-storing chamber portion 14*c* where the lower hole is not opened up to separation chamber 11 is shown in FIG. 15 by arrows (chain lines).

Further, gas stayed in oil-storing chamber portions 14*a* and 14*b* where substantially lower holes are opened is introduced into separation chamber 11 via lower hole 15 and passageway 24. Therefore, the gas in oil-storing chamber portions 14*a* and 14*b* can be discharged efficiently.

Further, because gas release passageway 23*b* forming a part of gas release passageway 23 is formed by utilizing a gap at a seal member providing portion where seal member 17 (O-ring) is provided between fixed scroll forming member 9 and compressor casing 10, it becomes unnecessary to separately form a groove with a complicated shape, etc. in order to form the gas release passageway 23*b*, and therefore, the workability in production can be improved.

Figure 17:
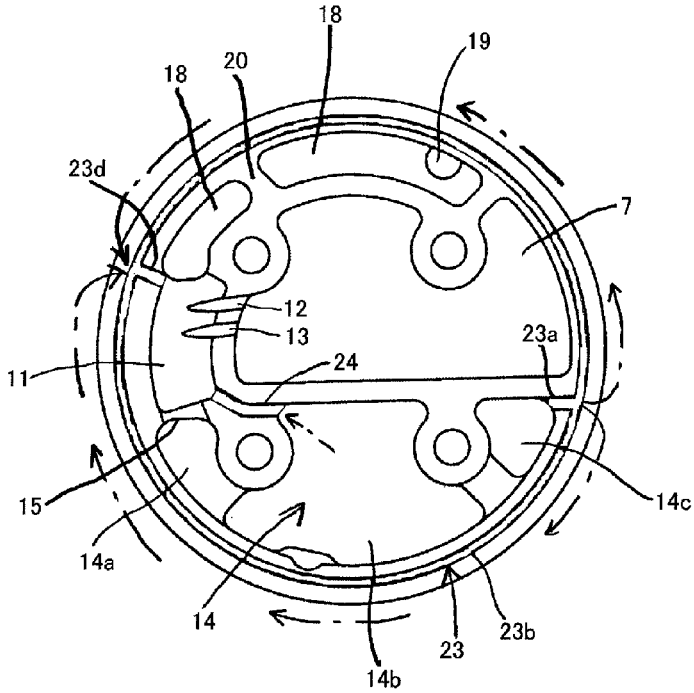
FIG. 17 is a cross-sectional view of a portion including a discharge chamber of a compressor incorporated with an oil separator according to a ninth embodiment of the present invention.
Figure 18:
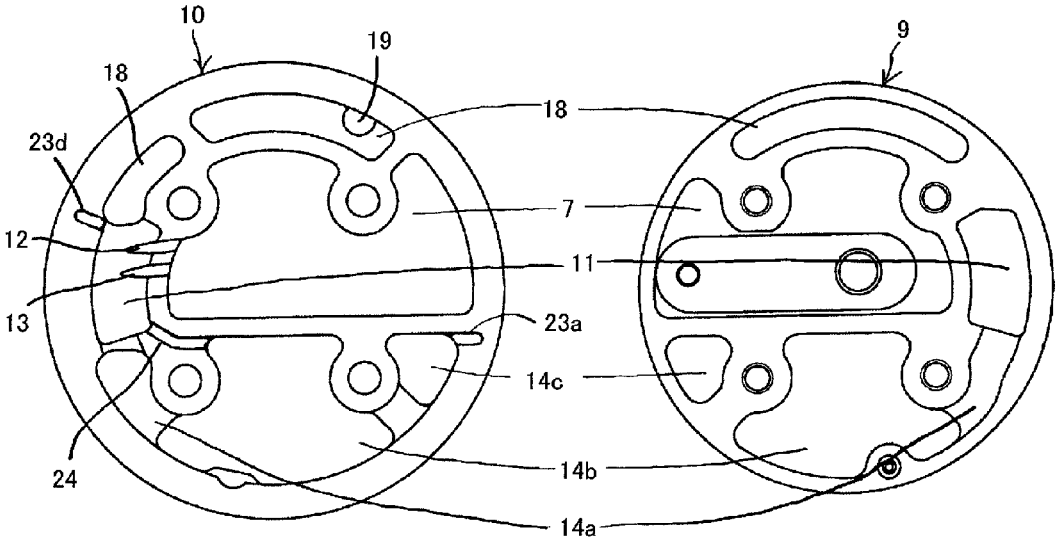
FIG. 18 is an exploded diagram showing a combination of a fixed scroll forming member and a casing which form an oil separator of the compressor depicted in FIG. 17.

FIGS. 17 and 18 depict a compressor incorporated with an oil separator according to a ninth embodiment of the present invention. Where, because the basic constitution of this embodiment is about same as that of the above-described eighth embodiment, the explanation for the same members as those in the eighth embodiment will be omitted by using the same symbols as those used in the eighth embodiment. Although gas release passageway 23*c* is opened at the lower end side of separation chamber 11 in the eighth embodiment, in this embodiment, gas release passageway 23*d* communicating between gas release passageway 23*b* and separation chamber 11 is opened at the upper end side of separation chamber 11. Also in such a structure, similarly to in the first embodiment, the gas stayed in the oil-storing chamber portion 14*c* where the lower hole is not opened can be discharged efficiently and securely. Further, gas stayed in oil-storing chamber portions 14*a* and 14*b* where substantially lower holes are opened is introduced into separation chamber 11 via lower hole 15 and passageway 24. Therefore, the gas in oil-storing chamber portions 14*a* and 14*b* can be discharged efficiently.

Figure 19:
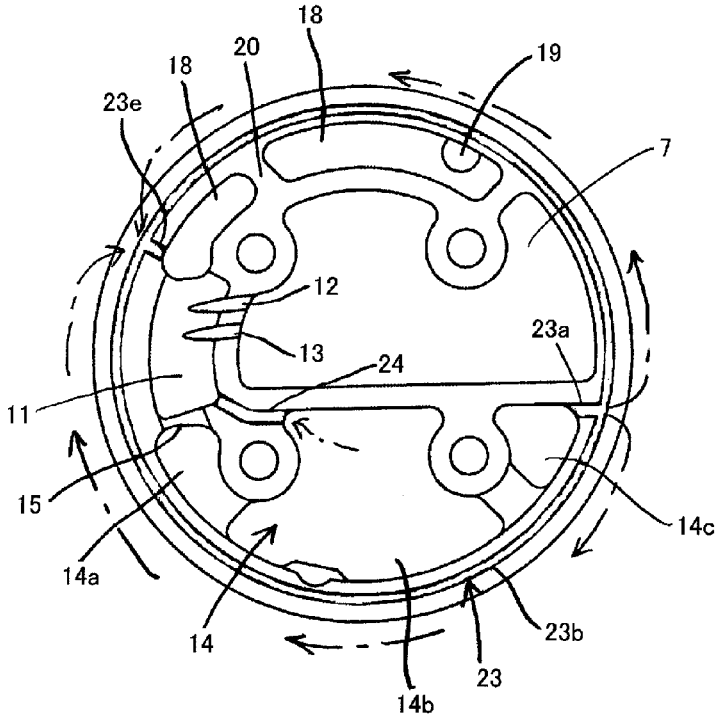
FIG. 19 is a cross-sectional view of a portion including a discharge chamber of a compressor incorporated with an oil separator according to a tenth embodiment of the present invention.
Figure 20:
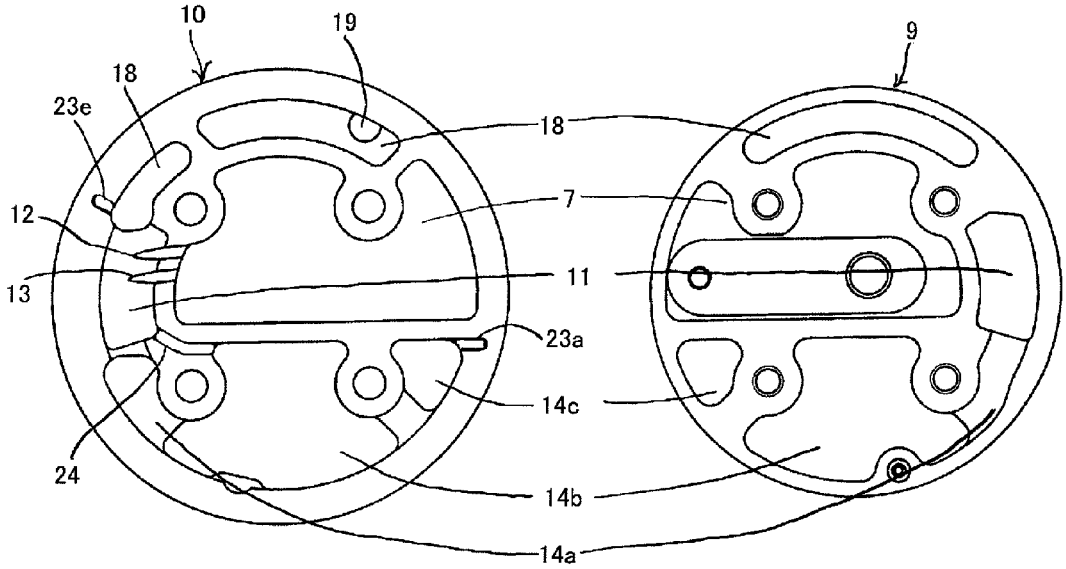
FIG. 20 is an exploded diagram showing a combination of a fixed scroll forming member and a casing which form an oil separator of the compressor depicted in FIG. 19.

FIGS. 19 and 20 depict a compressor incorporated with an oil separator according to a tenth embodiment of the present invention. Where, the explanation for the same members as those in the above-described first embodiment will be omitted by using the same symbols as those used in the first embodiment. In this embodiment, oil-storing chamber portion 14*b* where the lower hole is not opened is communicated with separation chamber 11 via passageway 24, and oil-storing chamber portion 14*c* is communicated with gas passageway 18 via gas release passageway 23. The gas release passageway 23 comprises gas release passageway 23*a* communicating with oil-storing chamber portion 14*c* where the lower hole is not opened, gas release passageway 23*b* introduced with gas from gas release passageway 23*a* and formed to extend in the circumferential direction of the compressor as shown in FIG. 19, and gas release passageway 23*e* communicating between gas release passageway 23*b* and gas passageway 18.

In this embodiment, gas stayed in oil-storing chamber portion 14*c* where the lower hole is not opened is introduced into separation chamber 11 by forming a flow path such as gas release passageway 23*a*-gas release passageway 23*b*-gas release passageway 23*e*. Therefore, the gas stayed in the oil-storing chamber portion 14*c* where the lower hole is not opened can be discharged efficiently and securely. The flow path for gas release from oil-storing chamber portion 14*c* where the lower hole is not opened up to gas passageway 18 is shown in FIG. 19 by arrows (chain lines). Further, gas stayed in oil-storing chamber portions 14*a* and 14*b* where substantially lower holes are opened is introduced into separation chamber 11 via lower hole 15 and passageway 24. Therefore, the gas in oil-storing chamber portions 14*a* and 14*b* can be discharged efficiently.

Figure 21:
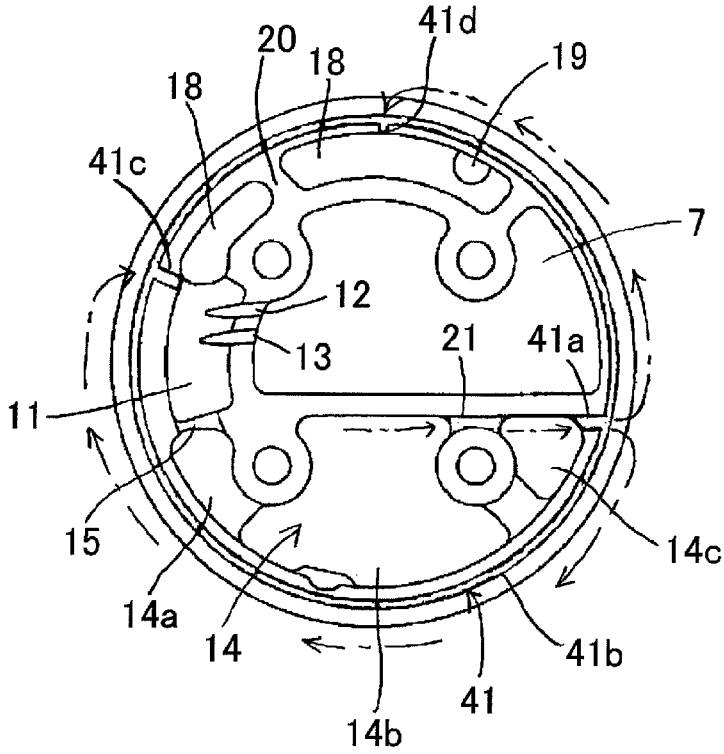
FIG. 21 is a cross-sectional view of a portion including a discharge chamber of a compressor incorporated with an oil separator according to an eleventh embodiment of the present invention.

FIG. 21 depicts a compressor incorporated with an oil separator according to an eleventh embodiment of the present invention. In this embodiment, oil-storing chamber portion 14*b* where the lower hole is not opened is communicated with oil-storing chamber portion 14*c* where the lower hole is not opened, via passageway 21, and further, the oil-storing chamber portion 14*c* is communicated with separation chamber 11 and gas passageway 18 via gas release passageway 41. The gas release passageway 41 comprises gas release passageway 41*a* communicating with oil-storing chamber portion 14*c* where the lower hole is not opened, gas release passageway 41*b* introduced with gas from gas release passageway 41*a* and formed to extend in the circumferential direction of the compressor as shown in FIG. 21, gas release passageway 41*c* communicating between gas release passageway 41*b* and separation chamber 11, and gas release passageway 41*d* communicating between gas release passageway 41*b* and gas passageway 18.

In this embodiment, gas stayed in oil-storing chamber portions 14*b* and 14*c* in each of which the lower hole is not opened is introduced into separation chamber 11 and gas passageway 18 by forming a flow path such as gas release passageway 41*a*-gas release passageway 41*b*-gas release passageways 41*c*, 41*d*. Therefore, the gas stayed in the oil-storing chamber portions 14*b* and 14*c* in each of which the lower hole is not opened can be discharged efficiently and securely. The flow path for gas release from oil-storing chamber portion 14*c* where the lower hole is not opened up to separation chamber 11 is shown in FIG. 21 by arrows (chain lines).

Figure 22:
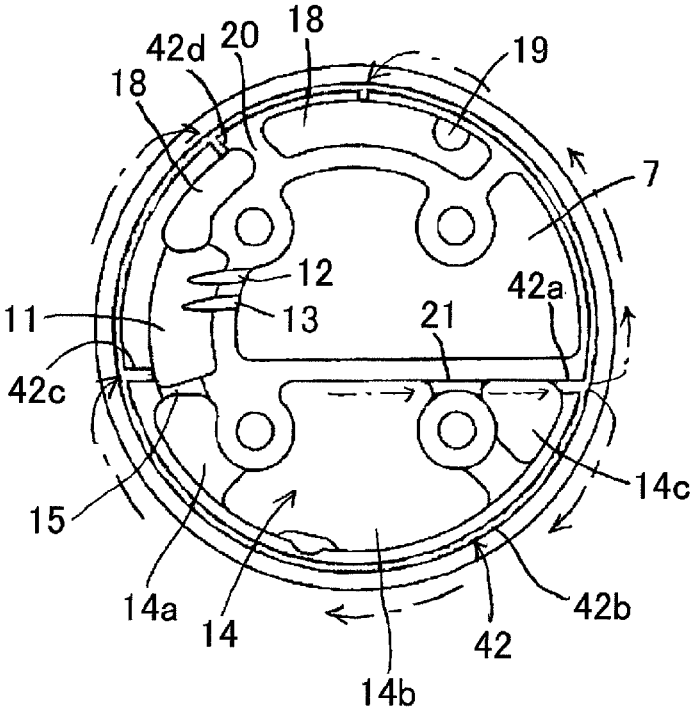
FIG. 22 is a cross-sectional view of a portion including a discharge chamber of a compressor incorporated with an oil separator according to a twelfth embodiment of the present invention.

FIG. 22 depicts a compressor incorporated with an oil separator according to a twelfth embodiment of the present invention. In this embodiment, oil-storing chamber portion 14*b* where the lower hole is not opened is communicated with oil-storing chamber portion 14*c* where the lower hole is not opened, via passageway 21, and further, the oil-storing chamber portion 14*c* is communicated with separation chamber 11 and gas passageway 18 via gas release passageway 42. The gas release passageway 42 comprises gas release passageway 42*a* communicating with oil-storing chamber portion 14*c* where the lower hole is not opened, gas release passageway 42*b* introduced with gas from gas release passageway 42*a* and formed to extend in the circumferential direction of the compressor as shown in FIG. 22, gas release passageway 42*c* communicating between gas release passageway 42*b* and separation chamber 11, and gas release passageways 42*d*, 42*e* communicating between gas release passageway 42*b* and gas passageway 18.

In this embodiment, gas stayed in oil-storing chamber portions 14*b* and 14*c* in each of which the lower hole is not opened is introduced into separation chamber 11 and gas passageway 18 by forming a flow path such as gas release passageway 42*a*-gas release passageway 42*b*-gas release passageways 42*c*, 42*d*, 42*e*. Therefore, the gas stayed in the oil-storing chamber portions 14*b* and 14*c* in each of which the lower hole is not opened can be discharged efficiently and securely. The flow path for gas release from oil-storing chamber portion 14*c* where the lower hole is not opened up to separation chamber 11 is shown in FIG. 22 by arrows (chain lines).

Figure 23:
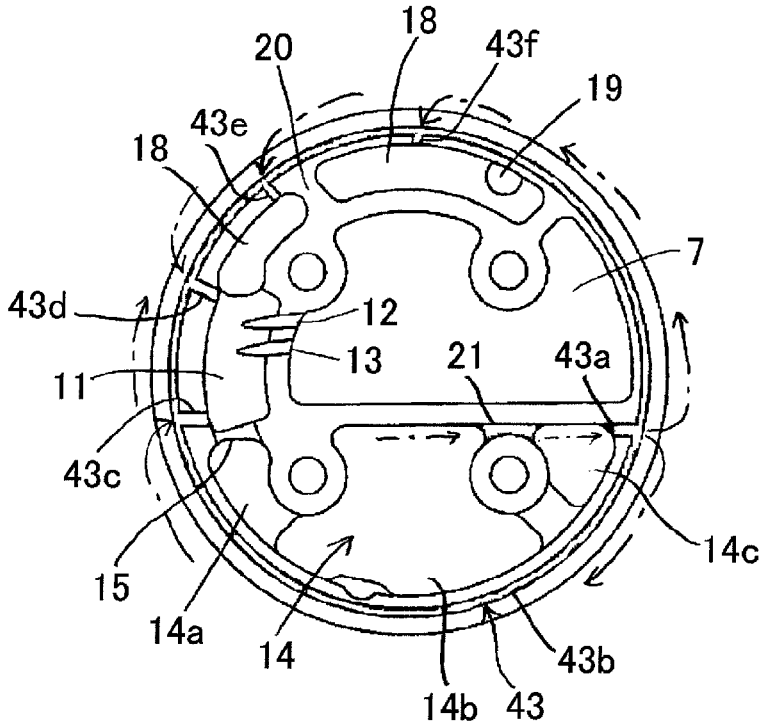
FIG. 23 is a cross-sectional view of a portion including a discharge chamber of a compressor incorporated with an oil separator according to a thirteenth embodiment of the present invention.

FIG. 23 depicts a compressor incorporated with an oil separator according to a thirteenth embodiment of the present invention. In this embodiment, oil-storing chamber portion 14*b* where the lower hole is not opened is communicated with oil-storing chamber portion 14*c* where the lower hole is not opened, via passageway 21, and further, the oil-storing chamber portion 14*c* is communicated with separation chamber 11 and gas passageway 18 via gas release passageway 43. The gas release passageway 43 comprises gas release passageway 43*a* communicating with oil-storing chamber portion 14*c* where the lower hole is not opened, gas release passageway 43*b* introduced with gas from gas release passageway 43*a* and formed to extend in the circumferential direction of the compressor as shown in FIG. 23, gas release passageways 43*c*, 43*d* communicating between gas release passageway 43*b* and separation chamber 11, and gas release passageways 43*e*, 43*f* communicating between gas release passageway 43*b* and gas passageway 18.

In this embodiment, gas stayed in oil-storing chamber portions 14*b* and 14*c* in each of which the lower hole is not opened is introduced into separation chamber 11 and gas passageway 18 by forming a flow path such as gas release passageway 43*a*-gas release passageway 43*b*-gas release passageways 43*c*, 43*d*, 43*e*, 43*f*. Therefore, the gas stayed in the oil-storing chamber portions 14*b* and 14*c* in each of which the lower hole is not opened can be discharged efficiently and securely. The flow path for gas release from oil-storing chamber portion 14*c* where the lower hole is not opened up to separation chamber 11 is shown in FIG. 23 by arrows (chain lines).

Figure 24:
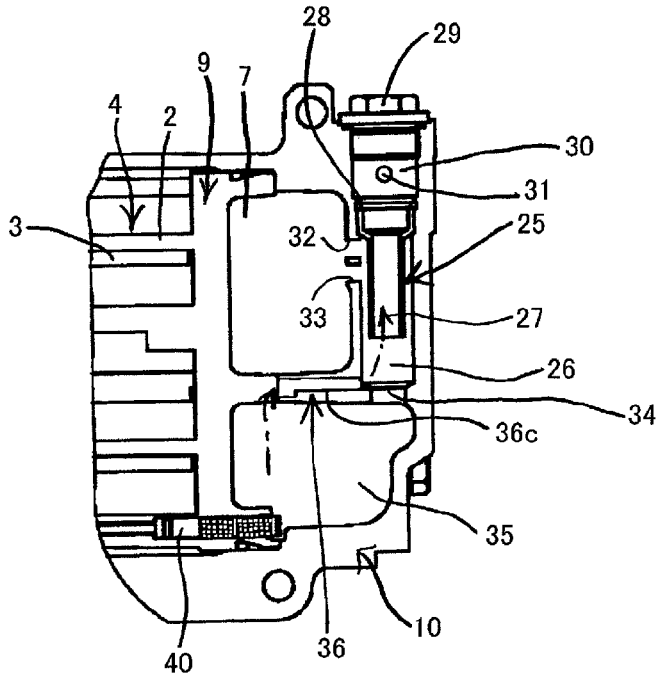
FIG. 24 is a vertical sectional view of a compressor incorporated with an oil separator according to a fourteenth embodiment of the present invention.
Figure 25:
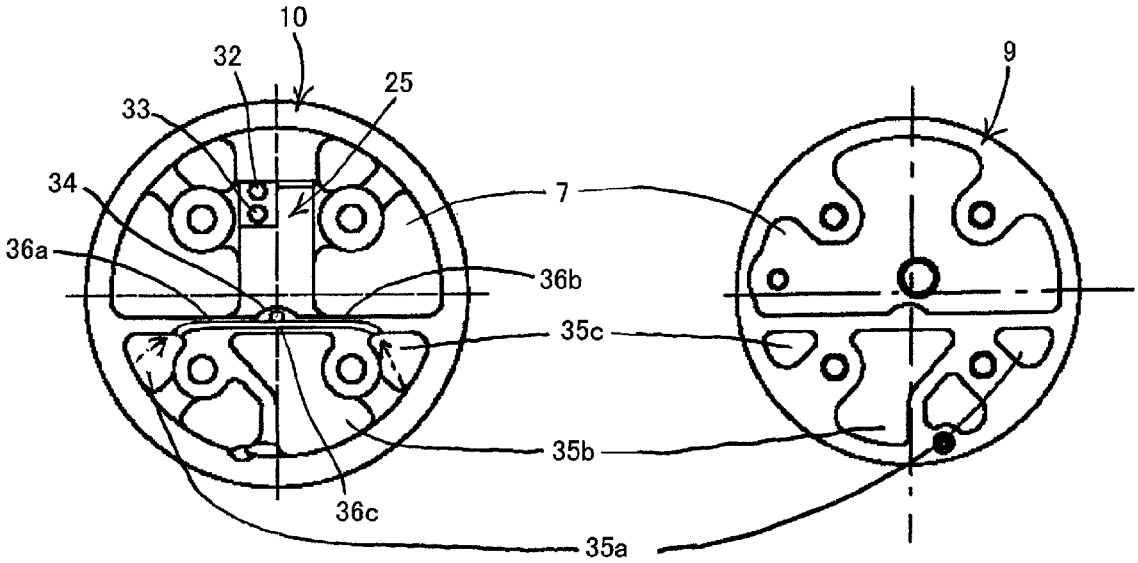
FIG. 25 is an exploded diagram showing a combination of a fixed scroll forming member and a casing which form an oil separator of the compressor depicted in FIG. 24.

FIGS. 24 and 25 depict a compressor incorporated with an oil separator, which is formed as a scroll-type compressor, according to a fourteenth embodiment of the present invention. Oil separator 25 is provided in discharge chamber 7. In oil separator 25, cylindrical separation chamber 26 is provided in casing 10 as an oil separation section, and on the axis thereof, separation pipe 27 is inserted or press fitted. In this embodiment, separation chamber 26 is formed in a cylindrical shape whose generating line extends straightly. The upper end of separation pipe 27 is fixed or engaged by snap ring 28. In this embodiment, separation chamber 26 is formed only by casing 10, and thereabove, seal bolt 29 is provided for keeping the inside pressure. Further, passageway 30 for gas having passed through the separation chamber is provided between the upper end of separation pipe 27 and the lower end of seal bolt 29, and discharge port 31 is provided on gas passageway 30.

The oil-containing gas compressed in compression mechanism 4 and introduced into discharge chamber 7 is introduced into separation chamber 26 through communication holes 32, 33. The introduced oil-containing gas rotates around separation pipe 27, and is separated into gas and oil utilizing centrifugal force. The separated gas passes through the inside of separation pipe 27 and is discharged from the discharge port via passageway 30 for gas having passed through the separation chamber. On the other hand, the separated oil is stored in oil storing chamber 35 provided under lower hole 34. The oil stored in oil storing chamber 35 is returned to the compression mechanism side through orifice 40.

Oil storing chamber 35 comprises oil-storing chamber portion 35*b* where the lower hole is opened and oil-storing chamber portions 35*a*, 35*c* in each of which the lower hole is not opened. Oil-storing chamber portions 35*a*, 35*c* in each of which the lower hole is not opened are communicated with separation chamber 26 via gas release passageway. 36. The gas release passageway 36 comprises a gas release passageway 36*a* introduced with gas from oil-storing chamber portion 35*a* where the lower hole is not opened, a gas release passageway 36*b* introduced with gas from oil-storing chamber portion 35*c* where the lower hole is not opened, and a gas release passageway 36*c* communicating between the gas release passageways 36*a*, 36*b* and the lower portion of separation chamber 26. Gas release passageways 36*a*, 36*b* are formed between fixed scroll forming member 9 and compressor casing 10. Further, gas release passageway 36*c* is formed to extend in the axial direction of the compressor as shown in FIG. 24.

In this embodiment, because oil-storing chamber portions 35*a*, 35*c* in each of which the lower hole is not opened and the lower portion of separation chamber 26 are communicated with separation chamber 26 via gas release passageway 36, the gas stayed in oil-storing chamber portion 35*a* where the lower hole is not opened is introduced into the lower portion of separation chamber 26 through gas release passageway 36*a* and gas release passageway 36*c*, passes through the inside of separation pipe 27, and is discharged to outside from discharge port 31 through passageway 30 for gas having passed through the separation chamber. Further, the gas stayed in oil-storing chamber portion 35*c* where the lower hole is not opened is introduced directly into the lower portion of separation chamber 26 through gas release passageway 36*b* and gas release passageway 36*c*, passes through the inside of separation pipe 27, and is discharged to outside from discharge port 31 through passageway 30 for gas having passed through the separation chamber. Therefore, the gas stayed in the oil-storing chamber portions 35*a*, 35*c* in each of which the lower hole is not opened can be discharged securely and efficiently.

Further, in this embodiment, because gas release passageways 36*a*, 36*b* are formed between fixed scroll forming member 9 and compressor casing 10, it becomes unnecessary to separately form a groove with a complicated shape, etc. in order to form the gas release passageways 36*a*, 36*b*, and therefore, the workability in production can be improved.

Figure 26:
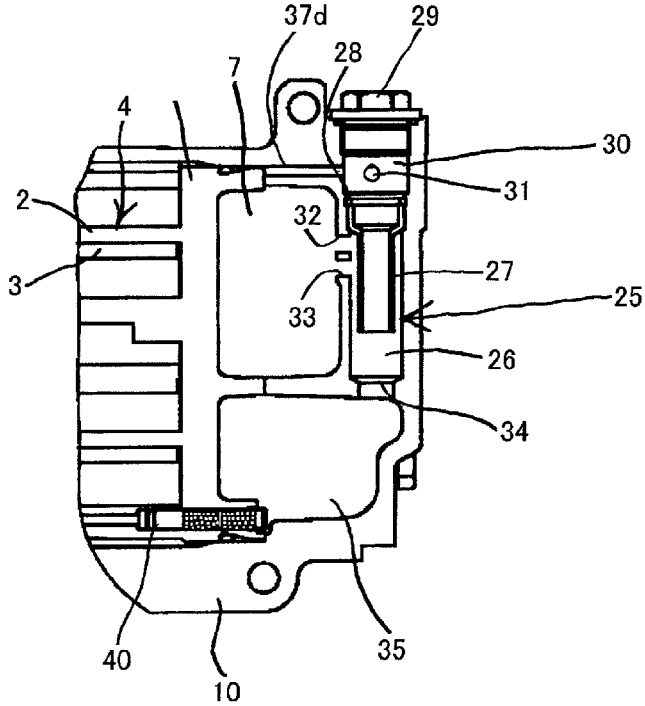
FIG. 26 is a vertical sectional view of a portion including a discharge chamber of a compressor incorporated with an oil separator according to a fifteenth embodiment of the present invention.
Figure 27:
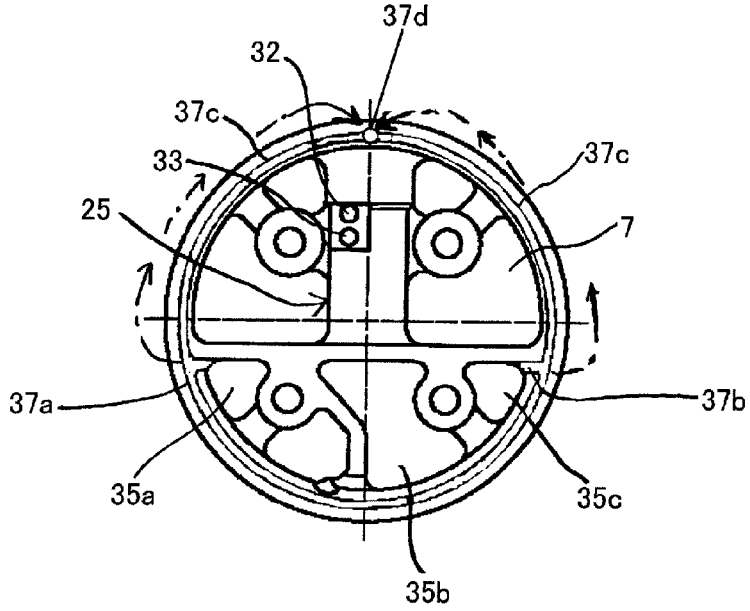
FIG. 27 is a cross-sectional view of a portion including a discharge chamber of the compressor depicted in FIG. 26.
Figure 28:
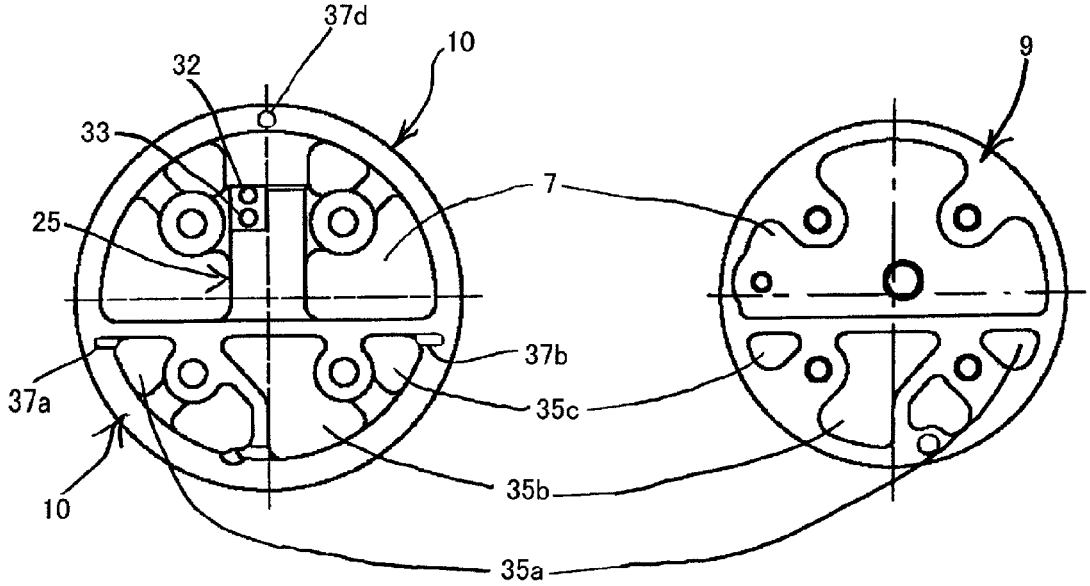
FIG. 28 is an exploded diagram showing a combination of a fixed scroll forming member and a casing which form an oil separator of the compressor depicted in FIG. 26.
Figure 29:
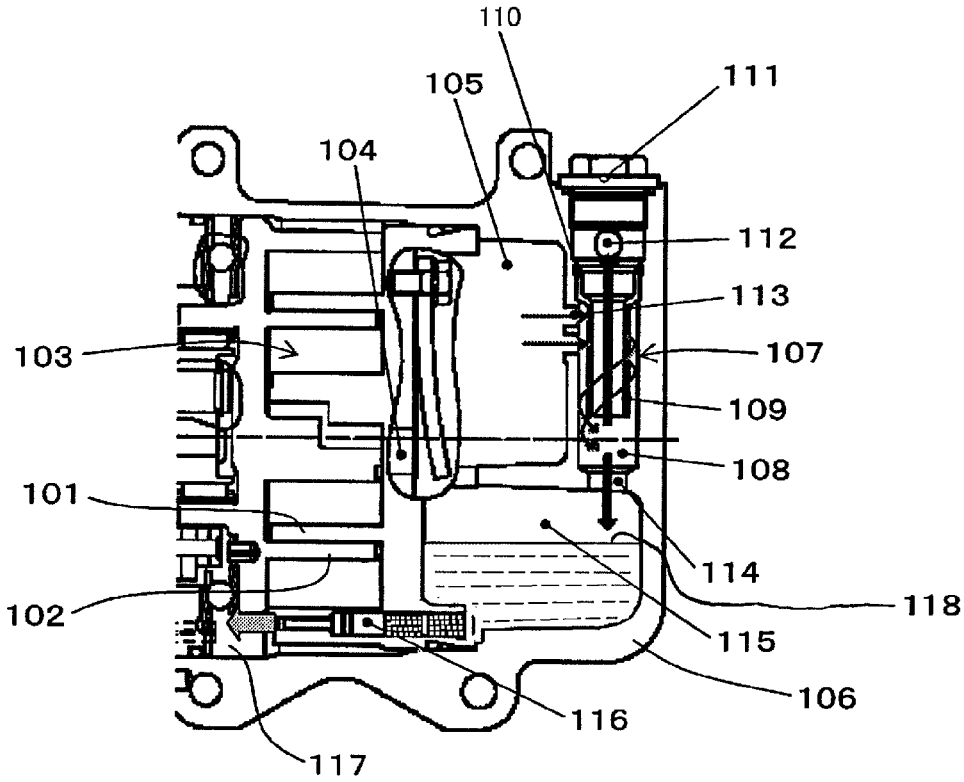
FIG. 29 Prior Art
FIG. 29 is a partial, vertical sectional view of a conventional compressor incorporated with an oil separator.
Figure 30:
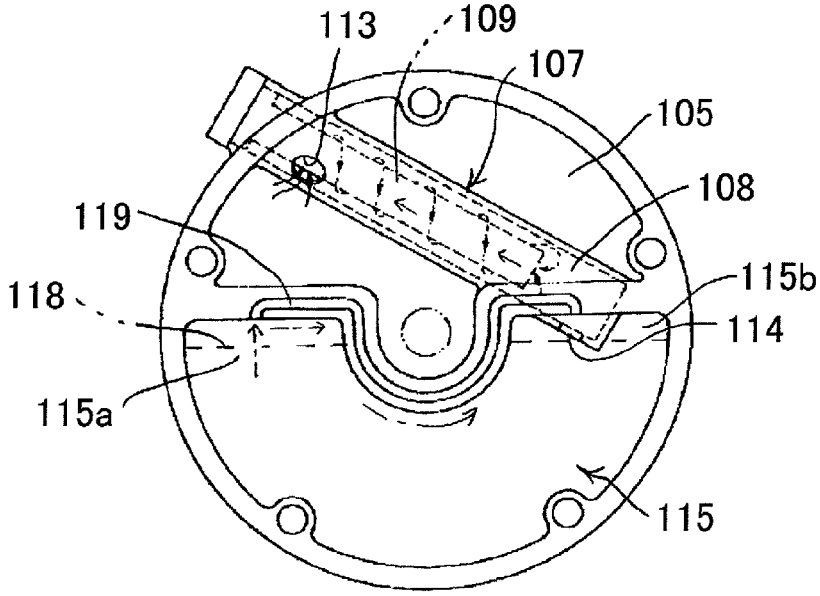
FIG. 30 Prior Art
FIG. 30 is a partial, vertical sectional view of another conventional compressor incorporated with an oil separator.

FIGS. 26-28 depict a compressor incorporated with an oil separator, which is formed as a scroll-type compressor, according to a fifteenth embodiment of the present invention. Where, the explanation for the same members as those in the above-described fourteenth embodiment will be omitted by using the same symbols as those used in the fourteenth embodiment. In this embodiment, oil storing chamber 35 comprises oil-storing chamber portion 35*b* where the lower hole is opened and oil-storing chamber portions 35*a*, 35*c* in each of which the lower hole is not opened.

Oil-storing chamber portions 35*a*, 35*c* in each of which the lower hole is not opened and passageway 30 for gas having passed through the separation chamber are communicated with each other via gas release passageway 37. The gas release passageway 37 comprises a gas release passageway 37*a* introduced with gas from oil-storing chamber portion 35*a* where the lower hole is not opened, a gas release passageway 37*b* introduced with gas from oil-storing chamber portion 35*c* where the lower hole is not opened, a gas release passageway 37*c* introduced with gas from gas release passageways 37*a*, 37*b* and provided to extend in the circumferential direction of the compressor, and a gas release passageway 37*d* communicating between gas release passageway 37*c* and passageway 30 for gas having passed through the separation chamber. Gas release passageways 37*a*, 37*b*, 37*c* are formed between fixed scroll forming member 9 and compressor casing 10. Further, gas release passageway 37*d* is formed to extend in the axial direction of the compressor as shown in FIG. 26.

In this embodiment, because oil-storing chamber portions 35*a*, 35*c* in each of which the lower hole is not opened and passageway 30 for gas having passed through the separation chamber are communicated with each other via gas release passageway 37, the gas stayed in oil-storing chamber portion 35*a* where the lower hole is not opened is introduced into passageway 30 for gas having passed through the separation chamber by forming a flow path such as gas release passageway 37*a*-gas release passageway 37*c*-gas release passageway 37*d*, and is then discharged to outside from discharge port 31. Further, the gas stayed in oil-storing chamber portion 35*c* where the lower hole is not opened is introduced into passageway 30 for gas having passed through the separation chamber by forming a flow path such as gas release passageway 37*b*-gas release passageway 37*c*-gas release passageway 37*d*, and is then discharged to outside from discharge port 31. Therefore, the gas stayed in the oil-storing chamber portions 35*a*, 35*c* in each of which the lower hole is not opened can be discharged securely and efficiently.

Further, because gas release passageways 37*a*, 37*b*, 37*c* are formed between fixed scroll forming member 9 and compressor casing 10, it becomes unnecessary to separately form a groove with a complicated shape, etc. in order to form the gas release passageways 37*a*, 37*b*, 37*c*, and therefore, the workability in production can be improved.

INDUSTRIAL APPLICATIONS OF THE INVENTION

The structure of the compressor incorporated with an oil separator according to the present invention can be applied to any type compressor incorporated with an oil separator, and in particular, it is suitable to a scroll-type compressor.

The invention claimed is:

1. A compressor incorporated with an oil separator comprising:

a discharge chamber;

an oil storing chamber;

a separation chamber, which is placed adjacent to said discharge chamber, wherein the entire inside of said separation chamber forms a space, wherein said separation chamber is configured to separate oil-containing gas introduced therein into gas and oil using centrifugal separation, wherein said separation chamber is configured to allow the separated oil to drop downward, and wherein said separation chamber is configured to upwardly extract the separated gas;

a lower hole formed in said separation chamber and configured to introduce the separated oil into said oil storing chamber, wherein said oil separator is formed as a joining structure of two compressor forming members; and a gas release passageway, at least a part of said gas release passageway formed between said two compressor forming members, wherein a portion of said oil storing chamber is communicated, via said gas release passageway, with a passageway configured to receive gas having passed through said separation chamber, wherein the portion of said oil storing chamber is a portion other than a portion where said lower hole is opened, and wherein said gas release passageway is formed to extend around at least a portion of an outer surface of said oil storing chamber near an outer edge of at least one of said two compressor forming members.

2. The compressor incorporated with an oil separator according to claim 1, wherein a plurality of openings of said gas release passageway to said passageway for gas having passed through said separation chamber are provided.

3. The compressor incorporated with an oil separator according to claim 1, wherein a stepped portion or a dam portion is provided in said passageway for gas having passed through said separation chamber.

4. The compressor incorporated with an oil separator according to claim 1, wherein a plurality of lower holes are provided in said separation chamber.

5. The compressor incorporated with an oil separator according to claim 1, wherein a part of said gas release passageway is formed by utilizing a gap at a seal member providing portion between said two compressor forming members.

6. The compressor incorporated with an oil separator according to claim 1, wherein said separation chamber is formed in a cylindrical shape whose generating line extends straightly.

7. The compressor incorporated with an oil separator according to claim 1, wherein said separation chamber is formed in a cylindrical shape whose generating line extends curvedly.

8. The compressor incorporated with an oil separator according to claim 1, wherein an opening direction to said separation chamber of a communication hole, which is configured to introduce oil-containing gas from said discharge chamber into said separation chamber, is a direction toward oil storing chamber side.

9. The compressor incorporated with an oil separator according to claim 8, wherein a plurality of communication holes are provided.

10. The compressor incorporated with an oil separator according to claim 9, wherein opening directions to said separation chamber of said plurality of communication holes are set at a same direction.

11. The compressor incorporated with an oil separator according to claim 9, wherein opening directions to said separation chamber of said plurality of communication holes are set at directions different from each other.

12. The compressor incorporated with an oil separator according to claim 1, wherein said compressor is a scroll compressor, one of said two compressor forming members is a fixed scroll forming member, and the other of said two compressor forming members is a compressor casing.

13. A compressor incorporated with an oil separator comprising:

a discharge chamber;

an oil storing chamber;

a separation chamber, which is placed adjacent to said discharge chamber, wherein the entire inside of said separation chamber forms a space, wherein said separation chamber is configured to separate oil-containing gas introduced therein into gas and oil using centrifugal separation, wherein said separation chamber is configured to allow the separated oil to drop downward, and wherein said separation chamber is configured to upwardly extract the separated gas;

a lower hole formed in said separation chamber and configured to introduce the separated oil into said oil storing chamber, wherein said oil separator is formed as a joining structure of two compressor forming members; and a gas release passageway, at least a part of said gas release passageway formed between said two compressor forming members, wherein a portion of said oil storing chamber is communicated, via said gas release passageway, with said separation chamber and a passageway configured to receive gas having passed through said separation chamber, wherein the portion of said oil storing chamber is a portion other than a portion where said lower hole is opened, and wherein said gas release passageway is formed to extend around at least a portion of an outer surface of said oil storing chamber near an outer edge of at least one of said two compressor forming members.

14. The compressor incorporated with an oil separator according to claim 13, wherein a plurality of openings of said gas release passageway to said separation chamber are provided.

15. The compressor incorporated with an oil separator according to claim 13, wherein a plurality of openings of said gas release passageway to said passageway for gas having passed through said separation chamber are provided.

16. The compressor incorporated with an oil separator according to claim 13, wherein a stepped portion or a dam portion is provided in said passageway for gas having passed through said separation chamber.

17. The compressor incorporated with an oil separator according to claim 13, wherein a plurality of lower holes are provided in said separation chamber.

18. The compressor incorporated with an oil separator according to claim 13, wherein a part of said gas release passageway is formed by utilizing a gap at a seal member providing portion between said two compressor forming members.

19. The compressor incorporated with an oil separator according to claim 13, wherein said separation chamber is formed in a cylindrical shape whose generating line extends straightly.

20. The compressor incorporated with an oil separator according to claim 13, wherein said separation chamber is formed in a cylindrical shape whose generating line extends curvedly.

21. The compressor incorporated with an oil separator according to claim 13, wherein an opening direction to said separation chamber of a communication hole, which is configured to introduce oil-containing gas from said discharge chamber into said separation chamber, is set at a direction toward oil storing chamber side.

22. The compressor incorporated with an oil separator according to claim 21, wherein a plurality of communication holes are provided.

23. The compressor incorporated with an oil separator according to claim 22, wherein opening directions to said separation chamber of said plurality of communication holes are set at a same direction.

24. The compressor incorporated with an oil separator according to claim 22, wherein opening directions to said separation chamber of said plurality of communication holes are set at directions different from each other.

25. The compressor incorporated with an oil separator according to claim 13, wherein said compressor is a scroll compressor, one of said two compressor forming members is a fixed scroll forming member, and the other of said two compressor forming members is a compressor casing.

26. A compressor incorporated with an oil separator having a discharge chamber;

an oil storing chamber;

a separation chamber, which is placed adjacent to said discharge chamber, comprises an oil separation pipe, wherein said separation chamber is configured to separate oil-containing gas introduced therein into gas and oil using centrifugal separation, wherein said separation chamber is configured to allow the separated oil to drop downward, and wherein said separation chamber is configured to upwardly extract the separated gas through said oil separation pipe;

a lower hole formed in said separation chamber and configured to introduce the separated oil into said oil storing chamber, wherein said oil separator is formed as a joining structure of two compressor forming members; and a gas release passageway, at least a part of said gas release passageway formed between said two compressor forming members, wherein a portion of said oil storing chamber is communicated, via said gas release passageway, with a passageway configured to receive gas having passed through said separation chamber, wherein the portion of said oil storing chamber is a portion other than a portion where said lower hole is opened, and wherein said gas release passageway is formed to extend around at least a portion of an outer surface of said oil storing chamber near an outer edge of at least one of said two compressor forming members.

27. The compressor incorporated with an oil separator according to claim 26, wherein a part of said gas release passageway is formed by utilizing a gap at a seal member providing portion between said two compressor forming members.

28. The compressor incorporated with an oil separator according to claim 26, wherein said separation chamber is formed in a cylindrical shape whose generating line extends straightly.

29. The compressor incorporated with an oil separator according to claim 26, wherein an opening direction to said separation chamber of a communication hole, which is configured to introduce oil-containing gas from said discharge chamber into said separation chamber, is set at a direction toward oil storing chamber side.

30. The compressor incorporated with an oil separator according to claim 29, wherein a plurality of communication holes are provided.

31. The compressor incorporated with an oil separator according to claim 30, wherein opening directions to said separation chamber of said plurality of communication holes are set at a same direction.

32. The compressor incorporated with an oil separator according to claim 30, wherein opening directions to said separation chamber of said plurality of communication holes are set at directions different from each other.

33. The compressor incorporated with an oil separator according to claim 26, wherein said compressor is a scroll compressor, one of said two compressor forming members is a fixed scroll forming member, and the other of said two compressor forming members is a compressor casing.

* * * * *